US006529701B2

(12) United States Patent
Baba et al.

(10) Patent No.: US 6,529,701 B2
(45) Date of Patent: Mar. 4, 2003

(54) IMAGE FORMING APPARATUS AND FIXING DEVICE

(75) Inventors: Motofumi Baba, Nakai-machi (JP); Yasuhiro Uehara, Nakai-machi (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 0 days.

(21) Appl. No.: 09/947,005

(22) Filed: Sep. 5, 2001

(65) Prior Publication Data

US 2002/0051659 A1 May 2, 2002

(30) Foreign Application Priority Data

Sep. 28, 2000 (JP) ..... 2000-296169

(51) Int. Cl.[7] ..... G03G 15/20
(52) U.S. Cl. ..... 399/307; 219/216
(58) Field of Search ..... 399/307, 329, 399/302, 308; 219/216

(56) References Cited

U.S. PATENT DOCUMENTS 5,233,397 A * 8/1993 Till ..... 399/307
5,866,875 A * 2/1999 Okabayashi ..... 219/216
5,999,788 A * 12/1999 Kanesawa ..... 399/329
6,088,565 A * 7/2000 Jia et al. ..... 399/302
6,282,392 B1 * 8/2001 Yamaguchi ..... 399/237

FOREIGN PATENT DOCUMENTS

| | | |
|---|---|---|
| JP | 2-106774 | 4/1990 |
| JP | 9-15933 | 1/1997 |
| JP | 11-352804 | 12/1999 |

* cited by examiner

*Primary Examiner*—Quana M. Grainger

(57) ABSTRACT

An image forming apparatus having an image carrier, a circularly driven intermediate transfer member and a transfer fixation device. The transfer fixation device includes a fixed pad, a pressure roll, a heating device and a corrugation suppression member. The fixed pad is brought into contact with an inner peripheral surface of the intermediate transfer member. The pressure roll is pressed against the fixed pad through the intermediate transfer member being interposed therebetween. The heating device for heating and melting the toner on the intermediate transfer member is located at an upstream side of a contact position of the fixed pad in a movement direction of the intermediate transfer member. The corrugation suppressing member provided along the inner peripheral surface of the intermediate transfer member in its circumferential direction is located between a position where the heating device is provided and a position where the fixed pad is provided.

24 Claims, 13 Drawing Sheets

IMAGE FORMING APPARATUS AND FIXING DEVICE

BACKGROUND OF THE INVENTION

1. Field of the Invention

The present invention relates to an image forming apparatus for forming a visible image by shifting toner to a latent image formed by a difference in electrostatic potential according to an electrophotographic system, electrostatic recording system, ionography or the like, and a fixing device for fixing a toner image, which has been transferred onto a recording medium, on the recording medium by heating and pressurization.

2. Description of the Related Art

A toner image formed by shifting toner to an electrostatic latent image on an image carrier is directly transferred onto a recording medium, or is once primary transferred onto an intermediate transfer member and is further secondary transferred from this intermediate transfer member onto a recording medium. For the transfer of the toner image, there is widely used a method in which a member for carrying an image is brought into contact with or is made to approach a member receiving a transferred image at a transfer portion, and an electric field is formed at this transfer portion to electrostatically shift the toner having an electric charge.

However, in the above method of electrostatically transferring the toner image, there is a case where scattering of the toner occurs, and resolution or dot reproducibility is lowered. Besides, in the case where toner images of plural colors are overlapped with each other and they are transferred at the same time, since transfer efficiency is not sufficient, there is also a case where uneven density or uneven color occurs in an image.

Under the circumstances, there is proposed a technique in which when toner on an intermediate transfer member is transferred onto a recording medium, a toner image on the intermediate transfer member is heated and melted, this is brought into press contact with the recording medium, and transfer and fixation are carried out at the same time.

Like this, the technique for carrying out the transfer and fixation at the same time can be classified according to methods and timing for carrying out heating and pressing as follows:

A first type is such that, for example, like a technique disclosed in Japanese Patent Unexamined Publication No. Hei. 2-106774, before a toner image on an intermediate transfer member is transferred, a recording member is heated, and toner on the intermediate transfer member is melted by heat of the recording member, and is transferred and fixed onto the recording member.

A second type is such that, for example, like a technique disclosed in Japanese Patent Unexamined Publication No. Hei. 9-15933, an endless belt shaped intermediate transfer member is overlapped with a recording medium, these are sent to a nip portion where a heating body and a pressure member are pressed against each other, and heating and pressurization are carried out.

A third type is such that, for example, like a technique disclosed in Japanese Patent Unexamined Publication No. Hei. 11-352804, a toner image is heated on an endless belt shaped intermediate transfer member, and the melted toner image is brought into press contact with a recording medium in a non-heating state.

Among the techniques as described above, in an apparatus of the third type in which after the toner image is heated and melted, it is brought into press contact with the recording medium in the non-heating state, much heat is not taken by a pressure member or the like at the time of heating, so that heating with high efficiency can be performed. Besides, like an apparatus disclosed in Japanese Patent Unexamined Publication No. Hei. 11-352804, by using an electromagnetic induction heating device as a heating device, the toner image can be heated up to a predetermined temperature in a short time, and a warm-up time at the time of starting the operation of the device becomes almost unnecessary.

On the other hand, there is widely conventionally used a device which electrostatically performs transfer of a toner image formed on an image carrier onto a recording medium. In such a device, transfer and fixation are not performed at the same time as described above, but after transfer is electrostatically performed, the toner image is fixed by a fixing device. That is, in the case where an image is directly transferred from the image carrier to the recording medium, the transfer is generally electrostatically performed, and thereafter, the toner image is fixed by the fixing device. Also in the case where an intermediate transfer member is used, both primary transfer from the image carrier to the intermediate transfer member and secondary transfer from the intermediate transfer member to the recording medium are electrostatically performed, and a fixing device is provided at the downstream side of the secondary transfer position to obtain a fixed image.

As the fixing device, many devices have been proposed, for example, a device in which a recording medium carrying a toner image is heated and pressed between two rolls having built-in heaters.

As one of them, there is a device in which an endless fixing belt is laid across in a tensioned condition and is circularly driven, and after this belt is heated, it is pressed against a recording medium carrying a toner image by pressure. This device heats the toner image by heat stored by the belt through heating and presses it onto the recording medium, and there is a merit that effective heating can be made by carrying out the heating at the upstream side of a nip portion where pressurization is made.

The above-described image forming apparatus in which secondary transfer and fixation are performed at the same time, and the fixing device in which the heated fixing belt is pressed against the recording medium by pressure have similar problems as described below.

A first problem is such that there is a case where a belt is deformed to corrugate between a position where a belt-like intermediate transfer member or a fixing belt is heated and its downstream nip portion. It appears that this corrugated state occurs since the intermediate transfer member or the fixing belt is heated, so that its portion is expanded, and distortion in the width direction is generated, and tensile force is introduced in the circumferential direction. Especially, in the image forming apparatus in which secondary transfer and fixation are performed at the same time, if the driving speed of the intermediate transfer member is high, heating must be made quickly, so that a low heat capacity thin belt is used, and a corrugated state becomes easy to generate in such a thin belt.

When the belt-like intermediate transfer member comes to have the corrugated state, an image to be transferred is distorted, or permanent wrinkles are produced, and a defect of the image is caused. Also in the case where the corrugated state occurs in the fixing belt, wrinkles which can not be restored are produced on the belt, and poor fixation is caused.

A second problem is such that since heating is not performed at the nip portion after the intermediate transfer member or the fixing belt is heated, poor fixation occurs, or toner remains on the belt, so-called offset can occur.

In general, in a nip portion, at least one of pressed members includes an elastic member, and a predetermined nip length in a circumferential direction is secured by the deformation of the elastic member. Then, the distribution of contact pressure (nip pressure) in this nip is such that the nip pressure is gradually increased from the upstream side in the movement direction of the belt, becomes maximum at a portion near the center, and is gradually decreased toward the nip outlet.

On the other hand, a temperature change when melted toner on the intermediate transfer member passes through the nip is such that when it runs into this nip, heat is absorbed by a recording medium or a pressure member and the temperature is quickly lowered. Thus, a sufficient nip pressure does not act at a portion near the nip inlet where the temperature of the toner is high, and a large nip pressure acts at the nip center portion where the temperature of the toner is lowered. Like this, even if the large pressure acts after the temperature of the toner is lowered and the fluidity is lowered, the toner does not sufficiently permeate the recording medium, and the poor fixation or offset occurs.

In a fixing device, when a recording medium carrying an unfixed toner image passes through a nip, the toner image comes in contact with a heated fixing belt at a nip inlet, and although the temperature is quickly raised to cause a melted state, thereafter, heat is diffused to the recording medium or a pressure member and is quickly decreased. Thus, similarly to the case of the intermediate transfer member, a sufficient nip pressure can not be obtained at a portion where the toner is melted and the temperature is high, and a high nip pressure acts at the nip center portion where the temperature of the toner is lowered. Thus, the poor fixation or offset is caused as well.

SUMMARY OF THE INVENTION

The present invention has been made in view of the above circumstances and provides an image forming apparatus which transfers and fixes a toner image on an intermediate transfer member to a recording medium at the same time and in which use efficiency of heat energy is improved and occurrence of image distortion and poor transfer is prevented, or a fixing device which fixes a toner image carried on a recording medium and in which use efficiency of heat energy is improved and occurrence of poor fixation and offset is prevented.

According to an aspect of the present invention, the image forming apparatus includes an image carrier which has an endless circumferential surface and on which a toner image is formed of toner selectively shifted onto the circumferential surface, an intermediate transfer member which is an endless belt shaped member laid across at least two members in a tensioned condition and is circularly driven, and onto an outer peripheral surface of which the toner image on the image carrier is primary transferred, and a transfer fixation device which heats the toner image on the intermediate transfer member, attaches the melted toner to a recording medium by pressure, and performs secondary transfer and fixation at the same time. In the transfer fixation device, a fixed pad is brought into contact with an inner peripheral surface of the intermediate transfer member, the intermediate transfer member is rubbed against a surface of the fixed pad, and a pressure roll presses the intermediate transfer member to the fixed pad to form a nip. A heating device for heating and melting the toner on the intermediate transfer member is provided at an upstream side of a contact position of the fixed pad in a movement direction of the intermediate transfer member, and a corrugation suppressing member for bringing a convex surface into close contact with the inner peripheral surface of the intermediate transfer member is provided between a position where the heating device is provided and a position where the fixed pad is provided.

In the image forming apparatus like this, the toner image formed on the image carrier is primary transferred onto the intermediate transfer member. Then, the toner image, together with the intermediate transfer member, is heated and melted by the heating device. The melted toner image is transported by circulating movement of the intermediate transfer member, is overlapped with a sheet-like recording medium, and is sent to the nip portion between the fixed pad and the pressure roll.

When the intermediate transfer member is heated by the above heating device, a heated portion is thermally expanded, and distortion is produced. Since the intermediate transfer member is circularly driven in a state where tensile force is introduced in the circumferential direction, it is in a state where corrugated wrinkles are easy to produce between the position where the heating device is provided and the nip portion. However, the corrugation suppressing member is brought into contact with the inner peripheral surface of the intermediate transfer member, and the intermediate transfer member is slid in the state where it is brought into close contact with this curved surface. Accordingly, the intermediate transfer member is moved without producing a corrugated state, and occurrence of distortion of the toner image carried by this is prevented.

The toner image sent to the nip is attached to the recording medium by pressure, and is fixed. Together with this, the heat of the toner is absorbed by the recording medium and the pressure roll, and the temperature is quickly lowered. Then, cohesive force of the toner becomes high at the outlet of the nip, and is peeled off from the intermediate transfer member in the state where it adheres to the recording medium and without causing the offset.

As the heating device used in the image forming apparatus, an electromagnetic induction heating device can also be used, in which the intermediate transfer member including a conductive layer is used and eddy current is generated in this layer to make heat generation. Besides, the heating device may be such that a thin metal plate is brought into contact with the intermediate transfer member, eddy current is generated in this metal plate to raise temperature, and the intermediate transfer member is brought into contact with this metal plate and is heated. Further, the heating device may be such that a member having a built-in heater or halogen lamp and coming in contact with the intermediate transfer member, for example, a heat roll is heated to a predetermined temperature, or a member such as a ceramic heater or resistance heat generator is brought into contact with the intermediate transfer member directly or through a member having low friction.

Further, although the fixed pad may be directly brought into contact with the intermediate transfer member and is slid, it is desirable to coat the surface with a layer for reducing abrasion.

The corrugation suppressing member provided between the heating device and the nip comes in contact with the intermediate transfer member heated by the heating device, and it is desirable that the member is made to have low heat capacity so that it does not absorb much heat from the intermediate transfer member. For example, it is desirable to use such a member that the curved surface is formed by working a heat-resistant film of synthetic resin etc., a thin metal plate, or the like. By using such a member, the heated toner image is kept at high temperature to the nip portion, and excellent transfer and fixation are performed. Besides, it is desirable that the corrugation suppressing member is arranged to be continuous with or close to the fixed pad to form a continuous convex curved surface, and sliding of the intermediate transfer member is made smooth.

Besides, it is desirable that the nip is set so that the pressure distribution has a maximum in the vicinity of the inlet. Specifically, there is used the fixed pad which is formed of an elastic material and in which the surface near the inlet of the nip is formed to be convex, the fixed pad which is made of an elastic material and in which a member hard to deform is embedded under the surface near the inlet of the nip, or the like.

Incidentally, the convex curved surface of the fixed pad, the corrugation suppressing member and the heating device can be made one or part of the members across which the endless belt shaped intermediate transfer member is laid in a tensioned condition.

On the other hand, the fixing device of the present invention has the following constitution.

The fixing device of the present invention heats and presses a sheet like recording medium on which a toner image formed by selective shift of toner is transferred, so that the toner image is fixed to the recording medium, and includes an endless fixing belt which is laid across at least two members in a tensioned condition and is circularly driven, a fixed pad fixedly supported to come in contact with an inner peripheral surface of the fixing belt, a pressure roll for interposing the fixing belt and the recording medium overlapped therewith between the pressure roll and the fixed pad to press them, a heating device for heating the fixing belt at an upstream side of a position where the fixed pad is brought into contact with the fixing belt, and a corrugation suppressing member brought into contact with the inner peripheral surface of the fixing belt between a position where heating of the toner image is performed and a position where the fixed pad is provided.

In this fixing device, the fixing belt is heated by the heating device, is overlapped with the recording medium carrying the unfixed toner image, and is sent to a nip portion where the fixed pad and the pressure roll are pressed against each other. In the nip, heat is supplied to the toner image on the recording medium from the heated fixing belt, and the toner image is melted and is attached to the recording medium by pressure.

In the process, the fixing belt heated by the heating device is thermally expanded at this portion, a difference in belt width occurs on the way to the nip, and distortion is produced. However, the corrugation suppressing member is brought into contact with the inner peripheral surface of the fixing belt at this portion. By this, the fixing belt moves in the state where it is in close contact with the corrugation suppressing member, and it is possible to prevent the section from being deformed and to prevent corrugated wrinkles from being produced in the circumferential direction.

As the hating device used in the fixing device, a device having the same structure as the device for heating the intermediate transfer member in the foregoing image forming apparatus can be adopted. A device having a built-in heater or halogen lamp, a device including a ceramic heater, a device performing electromagnetic induction heating, or the like can be used. With respect to the fixing belt as well, one having the same structure as the belt used as the intermediate transfer member described before can be used. Further, the corrugation suppressing member and the fixing pad can also be made to have the same structure.

Incidentally, in the fixing device, with respect to at least the two members across which the fixing belt is laid in a tensioned condition, one is a roll rotated and driven, and the other member is a rotatably supported roll, a fixedly supported pad, or the like. The fixed pad forming the nip can also be made one of the members across which the fixing belt is laid.

Although the above described fixing device is provided with the corrugation suppressing member between the region where the fixing belt is heated and the nip portion, it is also possible to adopt such a structure that the heating device includes a convex curved surface brought into contact with the inner peripheral surface of the fixing belt, and this curved surface is continuous with or close to the contact surface of the fixed pad to the fixing belt so that a continuous convex curved surface is formed.

This adopts in the fixing device the same structure as the structure in the secondary transfer portion of the above described image forming apparatus, in which the convex curved surface of the heating device is continuous with the contact surface of the fixed pad.

Also in the fixing device of such structure, the toner image on the recording medium is melted by heat stored in the fixing belt, and can be attached to the recording medium by pressure, and it is possible to prevent the fixing belt from having the corrugated state and to perform excellent fixation.

Besides, in the fixing device of the present invention, in the nip formed by the press contact of the fixed pad and the pressure roll, the nip pressure at a place near the inlet is made high, so that excellent fixation can be performed without producing poor fixation or offset.

In the nip, the heated fixing belt and the toner on the recording medium come in contact with each other, the temperature of the toner is quickly raised, and the toner is melted. However, thereafter, the heat is absorbed by the recording medium and the pressure roll, and the temperature of the toner is quickly lowered. In the above fixing device, the toner temperature at the place near the nip inlet is high, and the toner is pressed to the recording medium by a large nip pressure when the temperature is at least glass transition temperature of the toner, so that excellent fixation is realized.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Hereinafter, embodiments of the present invention will be described with reference to the drawings.

<First Embodiment>

Figure 1A:
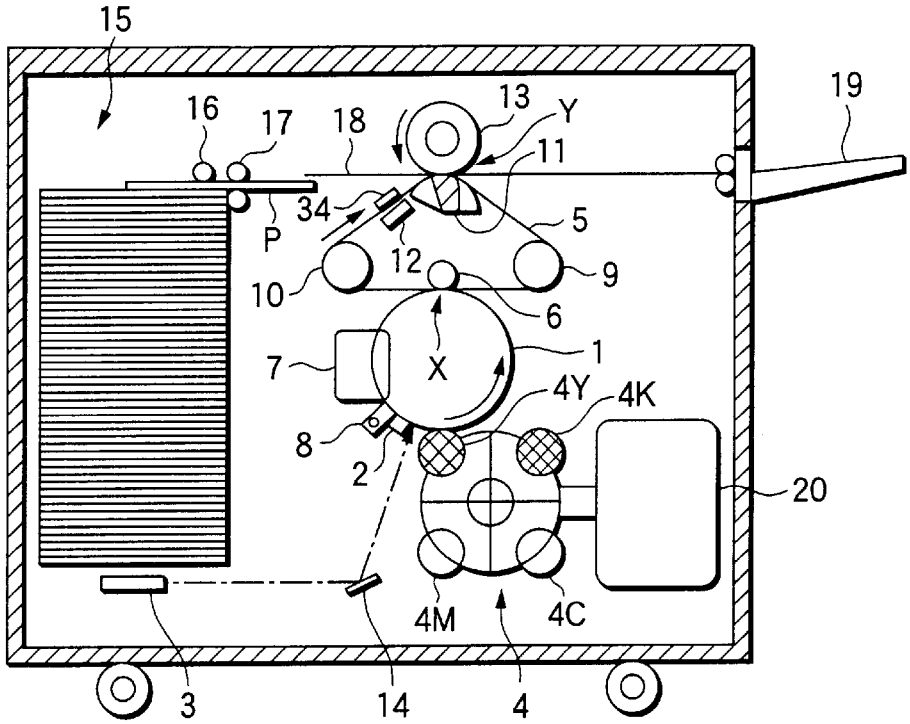
FIGS. 1A and 1B are schematic structural views showing an image forming apparatus of a first embodiment of the present invention.
Figure 1B:
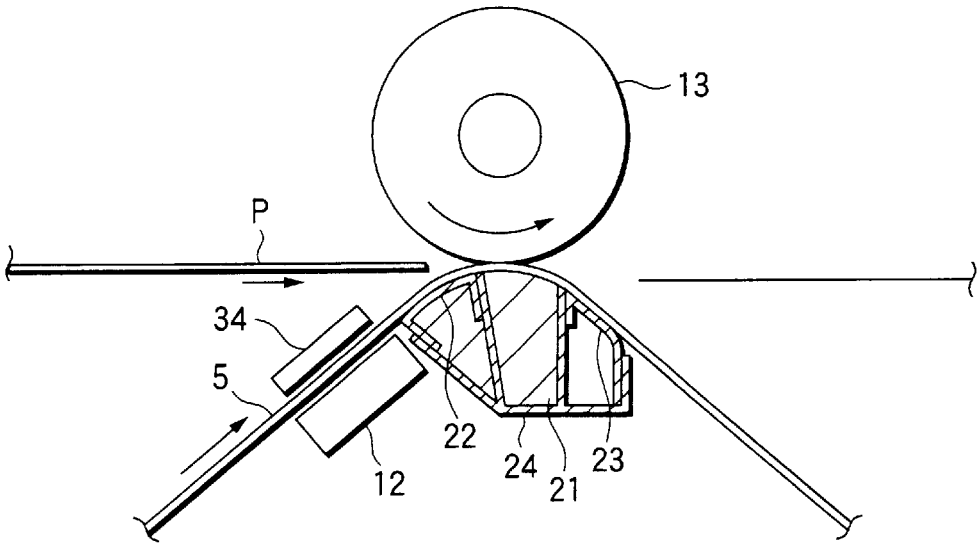

FIG. 1A is a schematic structural view showing an image forming apparatus of a first embodiment of the present invention, and FIG. 1B is an enlarged sectional view of a secondary transfer portion of this image forming apparatus.

This image forming apparatus includes a photosensitive drum 1 on the surface of which a latent image due to a difference in electrostatic potential is formed, and includes, around this photosensitive drum 1 (image carrier), a charging device 2 for almost uniformly charging the surface of the photosensitive drum, an exposure portion made of a laser scanner 3, a mirror 14 and the like, for irradiating the photosensitive drum 1 with laser lights corresponding to respective colors to form latent images, a rotary developing device 4 containing toners of four colors of cyan, magenta, yellow and black and for visualizing the latent images on the photosensitive drum by the toners of the respective colors, an endless belt shaped intermediate transfer member 5 supported to be able to circulate in a constant direction, a primary transfer roll 6 arranged to face the photosensitive drum 1 with the intermediate transfer member 5 being interposed therebetween and for transferring the toner image onto the intermediate transfer member 5, a cleaning device 7 for cleaning the surface of the photosensitive drum after transfer, and a charge-removal exposure device 8 for electricity-removing the surface of the photosensitive drum 1.

A driving roll 9, a tension roll 10, and a pressure unit 11 are arranged at the inside of the intermediate transfer member 5, and the intermediate transfer member 5 is laid across them in a tensioned condition. A pressure roll 13 is provided at a position where it faces the pressure unit 11 so that the intermediate transfer member 5 is interposed therebetween. An electromagnetic induction heating device 12 is provided at an upstream side of a position where the pressure unit 11 is provided, for heating the toner image from a back side of the intermediate transfer member 5. Further, the apparatus includes a sheet feeding roll 16 and a registration roll 17 for transporting recording members contained in a sheet feeding unit 15 one by one, a recording member guide 18 for supplying the recording member between the intermediate transfer member 5 and the pressure roll 11, and a sheet exhaust tray 19 for exhausting the recording member on which the toner image is transferred and fixed.

Next, each of the constituents of the image forming apparatus will be described in more detail.

The photosensitive drum 1 includes a photosensitive layer made of OPC, a-Si or the like on the surface of a cylindrical conductive base material, and the conductive base material is electrically grounded.

The charging device 2 is a corona discharge unit provided with a grid and an electrode wire, and the electrode wire is laid in a tensioned condition in parallel with the surface of the photosensitive drum 1. A high voltage is applied to the electrode wire, and a predetermined voltage is applied to the grid, so that corona discharge is generated between the electrode wire and the photosensitive drum 1, and the surface of the photosensitive drum 1 is uniformly charged.

The laser scanner 3 irradiates laser light flickering on the basis of an image signal, and makes exposure scanning by the polygon mirror in a main scanning direction of the photosensitive drum 1. By this, the potential of an exposed portion of the photosensitive drum 1 is attenuated, and a latent image due to a difference in potential is formed.

The developing device 4 includes four developer units 4C, 4M, 4Y and 4K respectively containing toners of cyan, magenta, yellow and black, and the respective development units are rotatably supported to face the photosensitive drum 1. A development roll for forming a toner layer on its surface to transport it to an opposite position to the photosensitive drum 1 is provided in each of the developer units. A voltage in which VDC of 400 V is superimposed on a rectangular alternate voltage having an alternate voltage value VP-P of 2 kV and a frequency f of 2 kHz is applied to the development roll, and the toner is shifted to the latent image on the photosensitive drum 1 by the action of an electric field. The toner is supplied to the respective developer units 4C, 4M, 4Y and 4K from a toner hopper 20.

Figure 2:
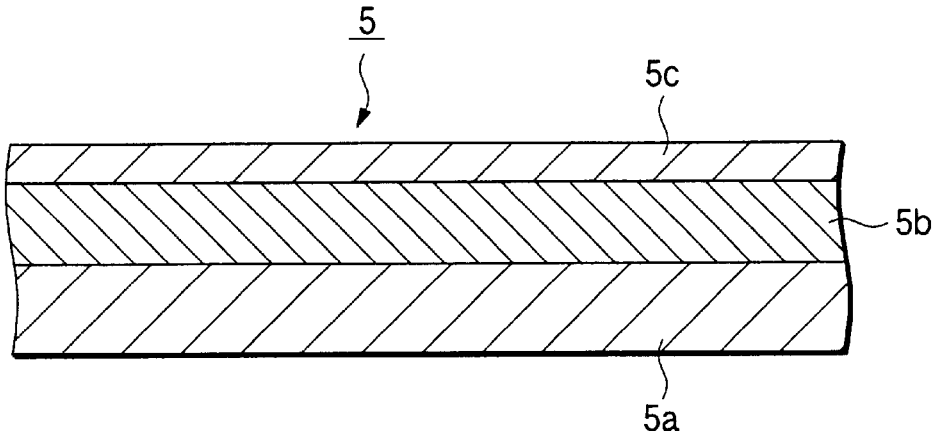
FIG. 2 is an enlarged sectional view of an intermediate transfer member used in the image forming apparatus shown in FIG. 1.

The intermediate transfer member 5 is constituted by, as shown in FIG. 2, three layers of a base layer 5*a* made of a high heat-resistant sheet-like member, a conductive layer (electromagnetic induction heat generating layer) 5*b* laminated thereon, and a surface release layer 5*c* of an uppermost layer. It is preferable that the base layer 5*a* is a semi-conductive member having a thickness of 10 $\mu$m to 100 $\mu$m, for example, a resin having high heat resistance, typified by polyester, polyethylene terephthalate, polyethersulfone, polyether ketone, polysulphan, polyimide, polyimidoamide, polyamide, or the like, dispersed with a conductive material such as carbon black is preferably used. Although the conductive material is dispersed in the base layer 5*a* in view of an electrostatic transfer property since a toner image is transferred by applying an electric field at the time of primary transfer, the structure of the base layer is not limited to this.

The conductive layer 5*b* is a layer of, for example, iron or cobalt, or a metal layer of nickel, copper, chromium or the like formed by plating process, having a thickness of 1 μm to 50 μm, and it is desirable to make the thickness about 1 μm to 20 μm. Especially, a thin layer of copper having a thickness of 1 μm to 15 μm is easily heated by electromagnetic induction and the intermediate transfer member becomes easy to cool after transfer and fixation. Thus, surplus heat is not stored, and heating excellent in use efficiency of thermal energy can be realized. Incidentally, the details of the conductive layer 5*b* will be described later.

It is preferable that the surface release layer 5*c* is a sheet or a coat layer having a thickness of 0.1 μm to 100 μm and a high release property. For example, tetrafluoroethylene-perfluoroalkyl vinyl ether copolymer, tetrafluoroethylene-silicone copolymer, or the like is used. Since toner is brought into contact with the surface release layer 5*c*, the material has a large influence on the picture quality. In the case where the material of the surface release layer is an elastic member, since the layer comes in close contact with the toner to wrap it, deterioration of an image is low and image gloss is uniform. However, in the case where the release material is a member having no elasticity, such as resin, since it is hard for toner to completely come in close contact with the recording member at the press contact portion to the recording member, poor transfer fixation and uneven image gloss are apt to occur. Especially, this is remarkable in the case of the recording member having large surface roughness. Accordingly, it is desirable that the material of the surface release layer 5*c* is an elastic member. Incidentally, in the case where resin is used for the material of the surface release layer, it is desirable that an elastic layer is provided between the surface release layer 5*c* and the conductive layer 5*b*. Then, in order to exhibit an effect of wrapping the toner, in either case, it is preferable that the thickness of the elastic layer is made not less than 10 μm, preferably not less than 20 μm.

A sliding layer made of a material containing a silicon compound may be provided at the inside of the base layer 5*a* of the intermediate transfer member to reduce friction against the rubbed pressure unit 11.

The silicon compound is, for example, a silane compound or silicone resin, and it is desirable to use a fluorine-containing silane compound, an isocyanate silane compound, or a silane coupling agent as the silane compound.

The circulation driving of the intermediate transfer member 5 is performed by the rotation of the driving roll 9 and the rotation of the pressure roll 13 pressing from the outside of the intermediate transfer member.

The intermediate transfer member 5 is processed so that friction becomes low at a portion where it is rubbed against the pressure unit 11, and friction force acting between the member and the peripheral surface of the driving roll 9 is also low. Thus, the circulation driving is made by both actions including driving force transmitted from the rotated pressure roll 13.

The primary transfer roll 6 is a conductive or semi-conductive roll, and electrostatically shifts a toner image on the photosensitive drum 1 onto the intermediate transfer member by applying a voltage between the roll and the photosensitive drum 1. In this embodiment, although the voltage is applied between the primary transfer roll 6 and the photosensitive drum 1, when the intermediate transfer member includes a conductive layer, transfer can also be performed in such a manner that the primary transfer roll is not used, but the voltage is applied between the photosensitive drum and the conductive layer of the intermediate transfer member to generate an electric field therebetween.

As shown in FIG. 1B, the main portion of the pressure unit 11 is constituted by a fixed pad 21 against which the pressure roll 13 is pressed and which forms a nip, a corrugation suppressing member 22 provided at an upstream side of the fixed pad 21 in a movement direction of the intermediate transfer member 5, a guide member 23 provided at a downstream side of the fixed pad 21, and a base portion 24 for supporting them together.

The fixed pad 21 is formed of a material which is elastically deformed and has heat resistance, for example, fluorine rubber or silicone rubber can be used. Its elastic coefficient is determined so that when the pressure roll is pressed, a contact region of a predetermined width, that is, a nip is produced, and a nip pressure is in a range of suitable values. Although the fixed pad can be made hard and formed of a material in which elastic deformation is difficult to produce, in this case, it is desirable to provide a layer made of an elastic material near the surface of the pressure roll. A surface of the fixed pad 21 which is brought into contact with the intermediate transfer member 5 is covered with a sheet-like member (not shown) for reducing friction. As the sheet-like member, a glass fiber sheet (for example, FGF400 made by Chuko Co., Ltd.) impregnated with fluorine resin or a porous fluorine resin film impregnated with oil can be used.

As the porous fluorine resin film, one formed by drawing, or one in which granular material of fluorine resin is sintered to form a sheet can be used. As the oil, it is desirable to use denatured silicone oil, especially silanol denatured silicone oil, carboxy denatured silicone oil, amino denatured silicon oil, dimethyl silicone oil, or the like. The oil can also be directly supplied between the fixed pad 21 and the rubbed intermediate transfer member 5 to reduce friction.

Figure 4A:
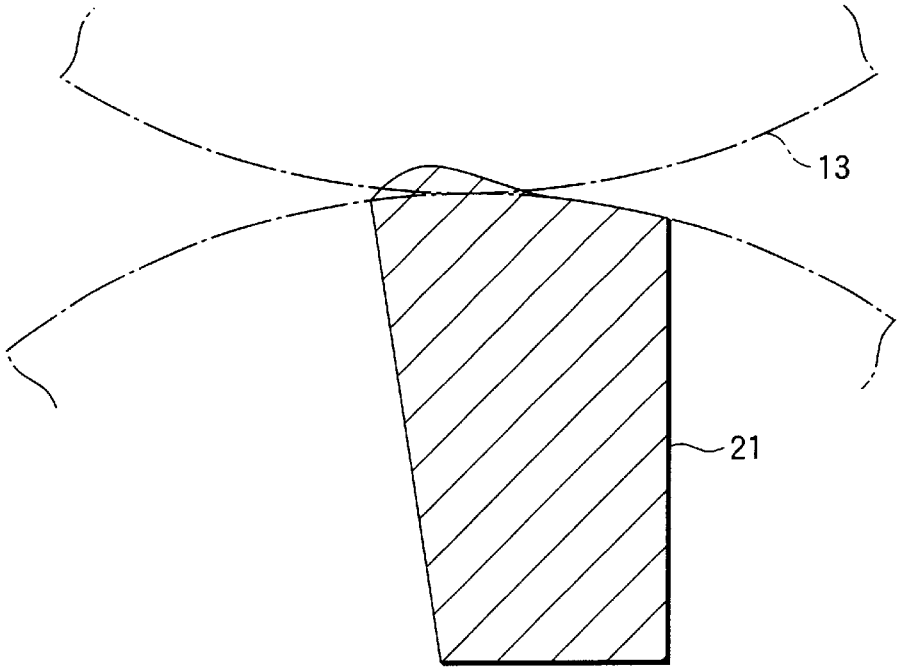
FIGS. 4A and 4B are schematic sectional views of fixed pads used in a secondary transfer portion of the image forming apparatus shown in FIG. 1A.
Figure 5A:
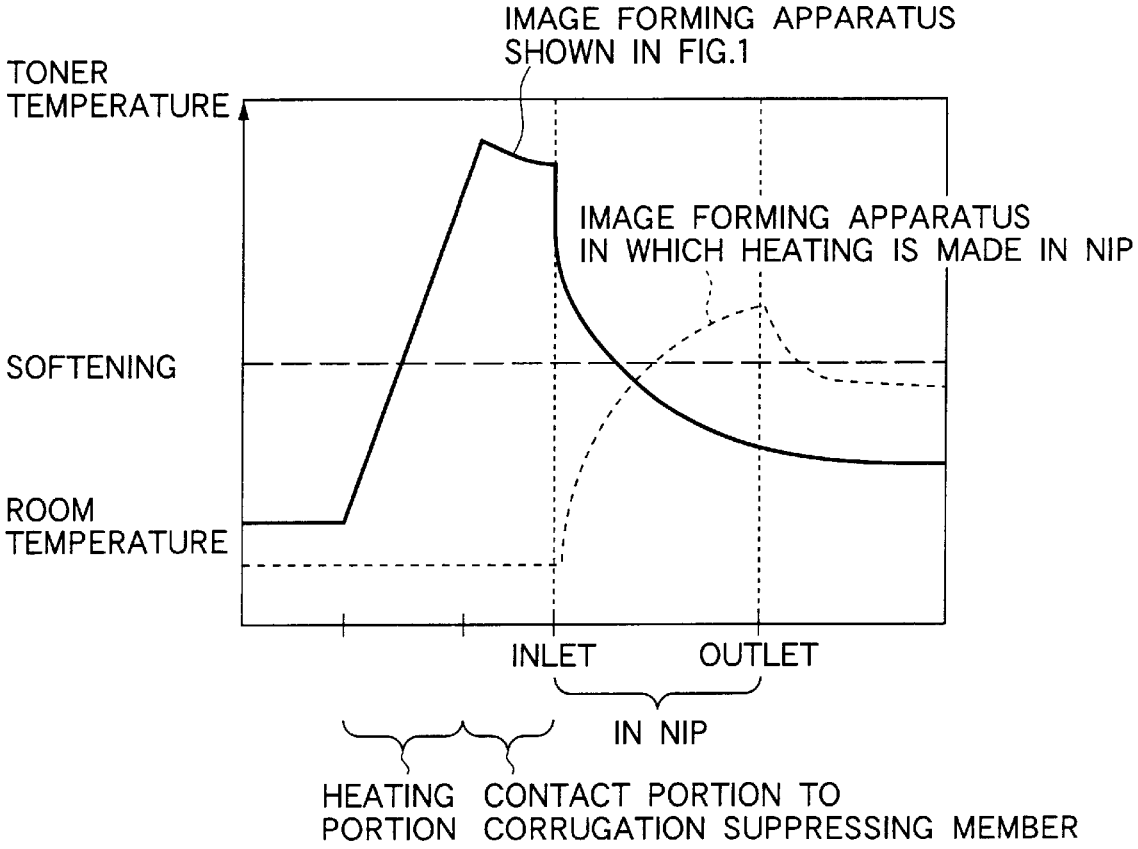
FIGS. 5A and 5B are views showing distributions of temperature of toner and nip pressure at a place near the secondary transfer portion of the image forming apparatus shown in FIG. 1A.
Figure 5B:
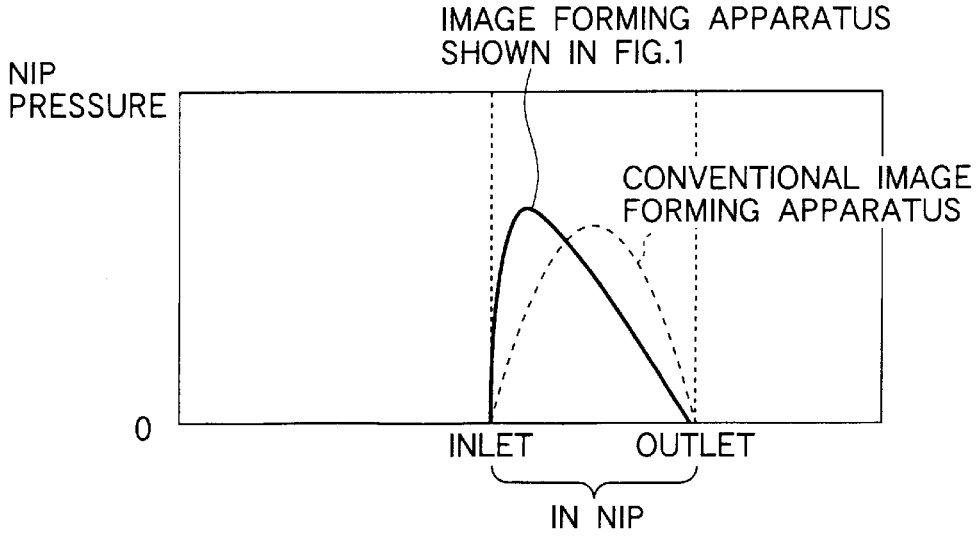

On the other hand, as shown in FIG. 4A, the surface of the fixed pad 21 which comes in contact with the intermediate transfer member 5 is shaped such that a portion near an inlet in the nip formed by press contact of the pressure roll 13 is expanded into a convex shape when the smooth cylindrical curved surface is made a standard. By the convex portion, the distribution of the nip pressure when the pressure roll 13 is pressed becomes such that it becomes maximum at a place near the inlet in the nip as shown in FIG. 5B.

That is, when the pressure roll is pressed, the convex portion is largely deformed along the surface shape of the pressure roll, and a high contact pressure in proportion to an amount of deformation is produced near the inlet of the nip.

Incidentally, a broken line shown in the drawing indicates the distribution of the nip pressure when the surface of the fixed pad is made a smooth cylindrical curved surface, for comparison with the apparatus of this embodiment.

Figure 4B:
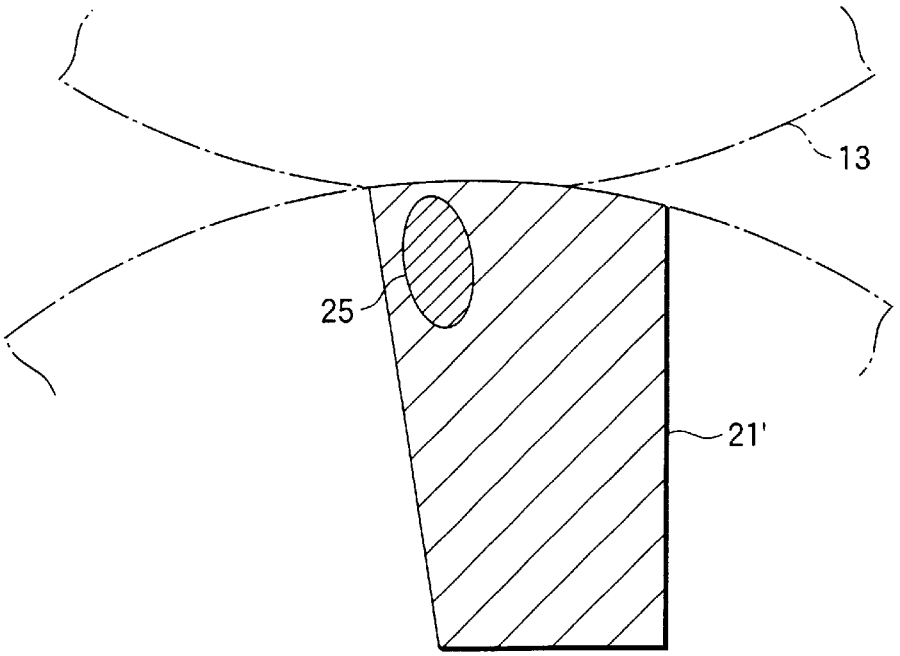

As means for making the distribution of the nip pressure large at a place near the inlet, in addition to the above, it can also be realized by embedding a highly hard member in the fixed pad. This is such that as shown in FIG. 4B, a member 25 which is hard to deform, such as metal, is embedded under the surface near the inlet of the nip, and the surface is formed to be a smooth cylindrical curved surface. The pressure roll 13 is pressed against a fixed pad 21' like this, and when the nip is formed, the deformation of a portion near the inlet of the nip is restricted by the member 25 which is hard to deform, so that the nip pressure is raised.

Like this, since the high contact pressure (nip pressure) is obtained near the inlet of the nip, it can be attached to a recording medium by pressure in the state where the toner has a high temperature and is melted, so that the occurrence of poor fixation and offset can be prevented.

Besides, a temperature sensor (not shown) can be embedded in the fixed pad 21 near the contact surface to the intermediate transfer member 5. It becomes possible to control the output of the heating device while the temperature at transfer and fixation is detected by this temperature sensor.

It is desirable that the nip where the fixed pad 21 is pressed against the pressure roll 13 is provided at the most upstream side of the fixed pad 21. Heat is supplied to the intermediate transfer member 5 from the electromagnetic induction heating device 12, and a predetermined amount of heat is stored. When the toner image is attached to the recording member by pressure before this heat is absorbed by the fixed pad 21, excellent transfer and fixation are performed. Thus, it is appropriate that setting is made so that at the same time or just before a position of the intermediate transfer member comes in contact with the fixed pad 21, the same position of the intermediate transfer member comes in contact with the pressure roll 13, and the recording member sent to the nip is pressed against the intermediate transfer member 5 by pressure as early as possible.

The corrugation suppressing member 22 provided at the upstream side of the fixed pad 21 is such that a cylindrical curved surface is formed by bending a film having a thickness of 5 $\mu$m to 100 $\mu$m and made of heat-resistant resin, such as polyimide or fluorine resin, or a metal thin plate having a thickness of 3 $\mu$m to 50 $\mu$m and made of stainless steel. As the heat-resistant resin, the material which can be used for the base layer 5*a* of the intermediate transfer member 5 can be used. By bringing the curved surface into close contact with the heated intermediate transfer member 5, it is possible to prevent the belt-like intermediate transfer member 5 from having a corrugated state.

The heat capacity of the corrugation suppressing member 22 is lowered by using the heat-resistant resin film or the metal thin plate, and even if the heated intermediate transfer member 5 is brought into close contact with it, an amount of heat taken from the intermediate transfer member 5 is small, and a drop in temperature is suppressed to be low.

It is desirable that the peripheral length of the corrugation suppressing member 22 is made 5 mm or more. Although the center radius of the curved surface is determined according to the thickness, hardness and the like of the belt, it is desirable that the radius is made about 20 mm to 40 mm. Further, the convex curved surface can also be made a so-called crown shape in which the center portion of the intermediate transfer member 5 in the width direction is expanded. By making such a shape, it is possible to more certainly prevent the intermediate transfer member 5 from having the corrugated state.

The guide member 23 provided at the downstream side of the fixed pad 21 is formed of a film of heat-resistant resin or a metal thin plate similarly to the corrugation suppressing member 22, is brought into contact with the intermediate transfer member 5 having passed through the nip, and guides the movement of the intermediate transfer member 5. Then, by using a member having small heat capacity, storage of heat in the guide member 23 is suppressed, and heat dissipation is facilitated from the intermediate transfer member 5 after it has passed through the nip.

The pressure roll 13 is pressed against the fixed pad 21 of the pressure unit 11 by pressure through the intermediate transfer member 5 interposed therebetween, and is rotated and driven to cause the circulation movement of the intermediate transfer member 5. Besides, the fixed pad 21 is deformed by pressing force, and the nip where the contact pressure acts is formed by this. The length of the nip and the movement speed of the recording member P are set so that a time when a point of the toner image on the recording member P passes through this nip becomes 10 ms to 50 ms.

The time when the toner exists in the nip, that is, the time from a point when the melted toner is pressed to the recording member P to a point when the recording member is peeled off from the intermediate transfer member 5 is suitably set, so that even if the toner is heated up to a temperature sufficient for the toner to adhere to the recording member, the temperature of the toner is lowered at the outlet of the nip to a such a degree that the offset does not occur.

Figure 3:
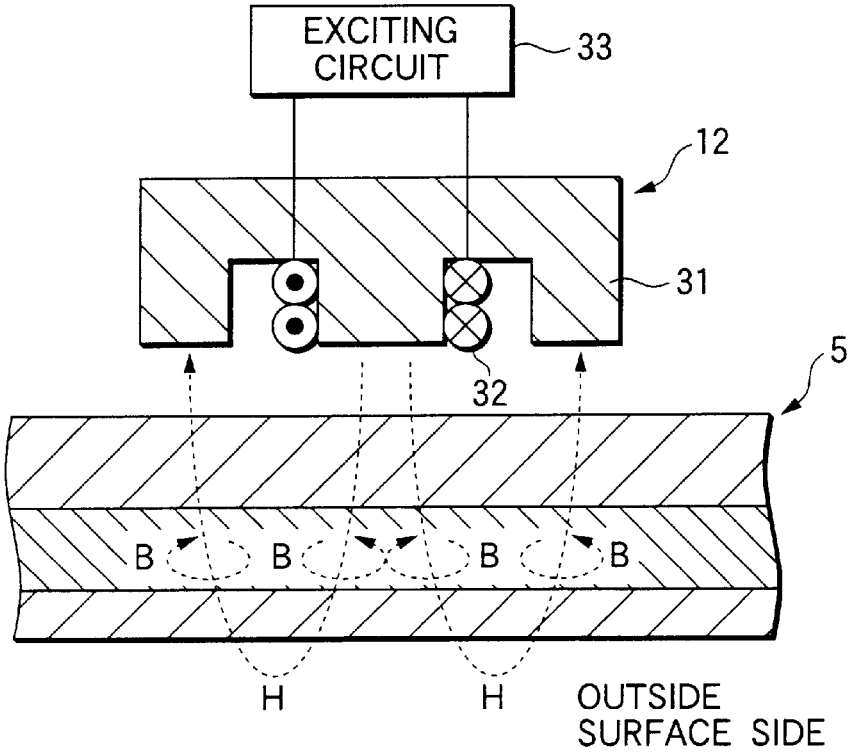
FIG. 3 is a schematic structural view of a heating device used in the image forming apparatus shown in FIG. 1A.

As shown in FIG. 3, the main portion of the electromagnetic induction heating device 12 is constituted by an iron core 31 having an E-shaped section, an exciting coil 32 wound around the iron core 31, and an exciting circuit 33 for applying an alternating current to the exciting coil 32. When the alternating current is applied to the exciting coil 32, magnetic flux indicated by arrow H around the exciting coil 32 repeats generation and extinction across the conductive layer 5*b* of the intermediate transfer member 5.

When the varying magnetic field crosses the conductive layer 5*b*, eddy current indicated by arrow B is generated in the conductive layer 5*b* so as to generate a magnetic field which prevents the change of the magnetic field. This eddy current is almost concentrated to the surface of the conductive layer 5*b* at the side of the exciting coil 32 by a skin effect and flows, and generates heat with electric power in proportion to skin resistance RS of the conductive layer 5*b*.

Here, when an angular frequency is $\omega$, magnetic permeability is $\mu$, and specific resistance is $\rho$, skin depth $\delta$ is expressed by the following expression.

$$\delta = \sqrt{\frac{2\rho}{\omega\mu}} \quad [1]$$

Further, the skin resistance RS is expressed by the following expression.

$$Rs = \rho/\delta = \sqrt{\frac{\omega\mu\rho}{2}} \quad [2]$$

When current flowing through the intermediate transfer member is If, electric power P generated in the conductive layer 5*b* of the intermediate transfer member 5 is expressed by the following expression.

$$P = Rs\int|If|2dS \quad [3]$$

Accordingly, if the skin resistance RS is made large or the current If flowing through the intermediate transfer member is made large, the electric power P can be increased, and the amount of heat generation can be increased. In order to increase the skin resistance RS, it is appropriate that the frequency wis made high or a material having high magnetic permeability $\mu$ or high specific resistance $\rho$ is used.

According to the heating principal as described above, if nonmagnetic metal is used for the conductive layer 5*b*, it is guessed that heating is hard to make. However, in the case where the thickness t of the conductive layer 5*b* is smaller than the skin depth $\delta$, since the following expression is obtained, heating becomes possible.

$$Rs \approx \rho|t \quad [4]$$

In the conductive layer 5*b*, if the material is not suitably selected in accordance with the thickness, and the frequency of AC voltage applied to the exciting coil from the power supply is not suitably selected, a heating state with high efficiency can not be obtained. This is very important selection in view of the capacity of the power supply and costs.

In this embodiment, copper with a thickness of 5 μm is used, or copper of 1 to 20 μm, aluminum, silver, or a conductive material having a specific resistance value (2.7 Å~$10^{-8}$ Ωm) equal to or less than these, is used, and voltage of a frequency of 15 kHz to 100 kHz is applied, so that the intermediate transfer member is efficiently heated.

Although it is preferable that the frequency of the AC voltage applied to the exciting coil 32 is made 10 to 500 kHz, especially in the case where copper or a material having a specific resistance value equal to or less than this is used for the conductive layer, it is desirable that the frequency is made 15 kHz to 100 kHz.

When the frequency is 10 kHz or higher, absorption efficiency to the conductive layer 5*b* becomes excellent, and the exciting circuit 33 can be assembled by using inexpensive elements up to 500 kHz. Further, if the frequency is 20 kHz or higher, it exceeds an audible range, so that a sound is not heard at the time of turning on electricity, and if the frequency is 200 kHz or lower, loss generated in the exciting circuit is low, and radiation noise to the periphery is also low.

Incidentally, in the case where AC current of 10 to 500 kHz is applied to the conductive layer 5*b,* the skin depth is about several pm to several hundreds μm.

With respect to the thickness of the conductive layer, the thinner, the better, since it is desirable that the heat capacity of the belt is as small as possible. However, as the thickness becomes small, the resistance value becomes large, and eddy current comes to hardly flow. Thus, it is desirable that the thickness is at least 1 μm. If the thickness is 1 μm or less, the frequency must be made high, so that not only the influence of radiation noise becomes large, but also the loss of elements of the power supply becomes large. Thus, such a thickness is not realistic and costs are also raised.

Besides, in the intermediate transfer member including the uniform conductive layer of 1 μm or less, since the conductive layer is very thin, there is a case where cracks are produced in the conductive layer or it is broken, and durability for keeping the heating state with high reliability becomes poor.

On the other hand, although the conductive layer of about 50 μm or less can be used, the thickness is desirably made 20 μm or less. If the thickness is not less than 20 μm, the heat capacity becomes large, so that it takes a long time to heat the intermediate transfer member up to a predetermined temperature, and it becomes difficult to quickly heat the intermediate transfer member. Thus, it becomes impossible to set the driving speed of the intermediate transfer member high. Further, since the resistance value becomes small, in the above material, such a problem becomes remarkable that Joule heat becomes hard to generate although eddy current flows. Accordingly, as the material of the conductive layer, it is necessary to select a material, such as iron or nickel, having a large specific resistance value.

In order to increase the heat generation of the conductive layer 5*b,* the current If flowing through the intermediate transfer member is made large, and for that purpose, the magnetic flux generated by the exciting coil 32 is made high, or the change of the magnetic flux is made large. As this method, the number of windings of the exciting coil 32 is increased, or the iron core 31 of the exciting coil 32 is made of a material having high magnetic permeability and low residual magnetic flux density, such as ferrite or permalloy.

If the resistance value of the conductive layer 5*b* is too small, heat generation efficiency when eddy current is generated deteriorates.

Incidentally, in this embodiment, although the conductive layer 5*b* is formed by the plating process or the like, it may be formed by vacuum evaporation, sputtering or the like. By this, aluminum or metal oxide alloy, which can not be subjected to the plating process, can be used for the conductive layer 5*b*. However, since it is easy to obtain a desired thickness, that is, a thickness of 1 to 50 μm by the plating process, the plating process is preferable.

Besides, as the material of the conductive layer 5*b,* for example, if a ferromagnetic material, such as iron, cobalt or nickel of high permeability, is used, it becomes easy to absorb electromagnetic energy generated by the exciting coil 32, and heating can be efficiently made. Further, since the magnetic field leaking to the outside of the apparatus also becomes low, and the influence on peripheral devices is also reduced, it is best to select a high resistivity material among these. The conductive layer 5*b* is not limited to metal, but the conductive layer 5*b* may be formed by dispersing conductive particles or whiskers of high magnetic permeability in an adhesive for bonding the low thermal conductivity base layer 5*a* to the surface release layer 5*c*. For example, the conductive layer can also be formed by mixing particles of manganese, titanium, chromium, iron, copper, cobalt, nickel or the like, particles or whiskers of ferrite of alloy of these or oxide, or conductive particles of carbon black or the like, into the adhesive and dispersing them.

Like this, although various metals can be used for the conductive layer, it is desirable that the layer uses a material having sufficiently low heat capacity. Especially, in the case where a thin film having a thickness of 1 to 20 μm is heated through electromagnetic induction, silver, copper, aluminum, or metal having a specific resistance equal to or larger than these, metal alloy, a metal layer of a multi-layer, or the like is suitable, and by using these, heating can be efficiently made. In view of specific resistance, thermal conductivity, specific heat, cost, and the like, it is most preferable to use copper.

A magnetic flux collecting member 34 may be provided at a position facing the electromagnetic induction heating device with the intermediate transfer member being interposed therebetween. This magnetic flux collecting member 34 forms a magnetic path for collecting the magnetic flux generated by the exciting coil and passing through the intermediate transfer member 5, and prevents leakage of the electromagnetic field and enables the coil to have high inductance. By this, magnetic coupling between the conductive layer of the intermediate transfer member 5 and the coil is enhanced, and high power factor can be realized.

The magnetic flux collecting member 34 is formed of a material having at least such properties that magnetic flux is easy to collect and eddy current is hard to generate (hard to heat by electromagnetic induction), for example, ferromagnetic ferrite, permalloy (alloy made of Fe—Ni—Mo etc.), rare earth transition metal compound (Nd—Fe—B, etc.), or crystal (P-NPNN, TDAE-C, etc.) of organic compound containing no metal can be used. Besides, it may be a laminate aggregate in which a plurality of thin metal plates, such as electric iron plates (typically silicon steel plates), are stacked. Further, it is more preferable that this magnetic flux collecting member has low hysteresis loss in magnetization history, and when high electric resistance, low eddy current loss, mass productivity, and the like are also taken into consideration, soft ferrite (ferrimagnetic oxide containing $Fe_2O_3$ as its main ingredient) or the like can be preferably used. On the other hand, with respect to the shape of the magnetic flux collecting member 34, various shapes can be adopted as long as the above object can be satisfied, and the shape is not particularly limited.

Besides, by the arrangement position of the magnetic flux collecting member 34, it becomes possible to change the distribution of the region of the intermediate transfer member 5 where heat is mainly generated. That is, between the case where the magnetic flux collecting member 34 is larger than the coil width in the circulating movement direction of the intermediate transfer member 5, and the case where it is smaller than that, the region of the intermediate transfer member where heat is mainly generated is narrower in the latter. Like this, as means for obtaining an ideal heat generation region distribution of the intermediate transfer member in the heating region, the above magnetic flux collecting member can also be used. Accordingly, a shift in a maximum temperature region, which occurs in the case where the peripheral speed of the intermediate transfer member is changed, can be eliminated by enabling the magnetic flux collecting member to move in the circumfernetial direction of the intermediate transfer member.

Next, the operation of the image forming apparatus having the structure as described above will be described.

The photosensitive drum 1 is rotated in the direction of an arrow indicated in FIG. 1A, and after it is almost uniformly charged by the charging device 2, laser light subjected to pulse width modulation in accordance with a yellow image signal of a document is irradiated from the laser scanner 3, and an electrostatic latent image corresponding to a yellow image is formed on the photosensitive drum 1. The electrostatic latent image for the yellow image is developed by the developer unit 4Y for yellow which is located at a development position in advance, so that a yellow toner image is formed on the photosensitive drum 1.

This yellow toner image is electrostatically transferred onto the intermediate transfer member 5 by the action of the primary transfer roll 6 at a primary transfer portion X as a contact portion between the photosensitive drum 1 and the intermediate transfer member 5. This intermediate transfer member 5 is circularly moved in synchronization with the photosensitive drum 1, the circular movement is continued while the yellow toner image is held on the surface, and it prepares transfer of a magenta image of a next color.

On the other hand, after the surface of the photosensitive drum 1 is cleaned by the cleaning device 7, it is again almost uniformly charged by the charging device 2, and laser light is irradiated from the laser scanner 3 in accordance with a next magenta image signal.

The rotary developing device 4 is rotated while an electrostatic latent image for magenta is formed on the photosensitive drum 1, the developer unit 4M for magenta is positioned at the development position, and development by the magenta toner is carried out. A magenta toner image formed in this way is electrostatically transferred onto the intermediate transfer member 5 at the primary transfer portion X, and is overlapped with the previous yellow toner image.

Subsequently, the foregoing process is performed with respect to cyan and black, and when the toner images of the four colors are overlapped on the intermediate transfer member 5, or in the middle of the transfer of black of the final color, the recording member P (sheet) contained in the sheet feeding unit 15 is sent out by the sheet feeding roll 16, and is transported to a secondary transfer portion Y of the intermediate transfer member 5 via the resist roll 17 and the recording member guide 18.

On the other hand, the toner images of the four colors transferred onto the intermediate transfer member 5 pass through the heating region opposite to the magnetic induction heating device 12 at the upstream side of the secondary transfer portion Y. In the heating region, AC current is applied from the exciting circuit 33 to the exciting coil 32, and the conductive layer 5*b* of the intermediate transfer member 5 is heated by the electromagnetic induction heating. By this, the conductive layer 5*b* is rapidly heated, this heat is instantaneously transmitted to the surface layer, and the toner on the intermediate transfer member 5 comes to have a melted state.

At this time, the intermediate transfer member 5 is locally heated, and only a portion where the temperature is raised is thermally expanded. Besides, tensile stress is introduced in the circumferential direction. Thus, although corrugated wrinkles in the circumfernetial direction become easy to generate between the heating portion and the nip portion, the convex curved surface of the corrugation suppressing member 22 is brought into contact at this portion. The intermediate transfer member 5 comes in close contact with the convex curved surface and is moved along this curved surface. By this, the thin belt-like intermediate transfer member 5 is prevented from having the corrugated state.

The corrugation suppressing member 22 has low heat capacity and is thermally saturated in a short time after the start of heating, and the quantity of heat taken from the rubbed intermediate transfer member 5 is small. Thus, the heated intermediate transfer member 5 is moved to the nip portion (secondary transfer portion Y) while the temperature hardly drops.

The toner images melted on the intermediate transfer member 5 are brought into close contact with the recording member P by the pressure of the pressure roll 11 at the secondary transfer portion Y. In the heating region, only the vicinity of the surface of the intermediate transfer member 5 is locally heated, and the melted toner comes in contact with the recording member having room temperature and is rapidly cooled. That is, when the melted toner passes through the nip, it is instantaneously permeated in the recording member by the thermal energy of the toner and the pressing force and is subjected to transfer and fixation, and the recording member is transported to the outlet of the nip while absorbing the heat of the toner and the intermediate transfer member 5 which is heated at only the vicinity of the surface. The temperature of the toner from the time of heating by the electromagnetic induction heating device 12 to the time of passing through the nip becomes as shown by a solid line in FIG. 5A. On the other hand, the distribution of the nip pressure is set so that it becomes maximum at a place near the inlet of the nip as shown by a solid line in FIG. 5B. Accordingly, the toner is pressed to the recording member by a high pressure when its temperature is high, so that the toner in the melted state is certainly permeated in the recording member.

When the nip width and the movement speed of the recording member are suitably set, the temperature of the toner at the outlet of the nip becomes lower than the softening temperature. Thus, cohesive force of the toner becomes high, and the toner image is almost completely transferred and fixed onto the recording member without generating the offset. Incidentally, a broken line in FIG. 5A shows the temperature of toner in the case where heating is made in the nip, for comparison with the apparatus shown in FIG. 1A.

Thereafter, the recording member on which the toner images are transferred and fixed passes through an exhaust roll and is sent onto the sheet exhaust tray 19, and the full color image formation is completed.

Like this, in the image forming apparatus of this embodiment, in the heating region opposite to the electromagnetic induction heating device 12, only the conductive layer of the intermediate transfer member 5 which absorbs the electromagnetic wave is heated, and the heat capacity of the intermediate transfer member is small, so that the toner can be instantaneously melted. Then, in the secondary transfer region Y, the toner heated and melted in the heating region comes in pressure contact with the recording member of the room temperature, so that the fixation is carried out at the same time as the transfer. Since the intermediate transfer member 5 has small heat capacity, the heat is absorbed by the recording member, and the temperature of the intermediate transfer member 5 rapidly drops immediately after the transfer and fixation. Thus, storage of heat in the apparatus becomes very low.

The heated intermediate transfer member reaches the nip portion without generating the corrugated wrinkles, the melted toner images are attached to the recording member by the suitable distribution of the nip pressure, and the excellent transfer and fixation is carried out.

<Second Embodiment>

Figure 6A:
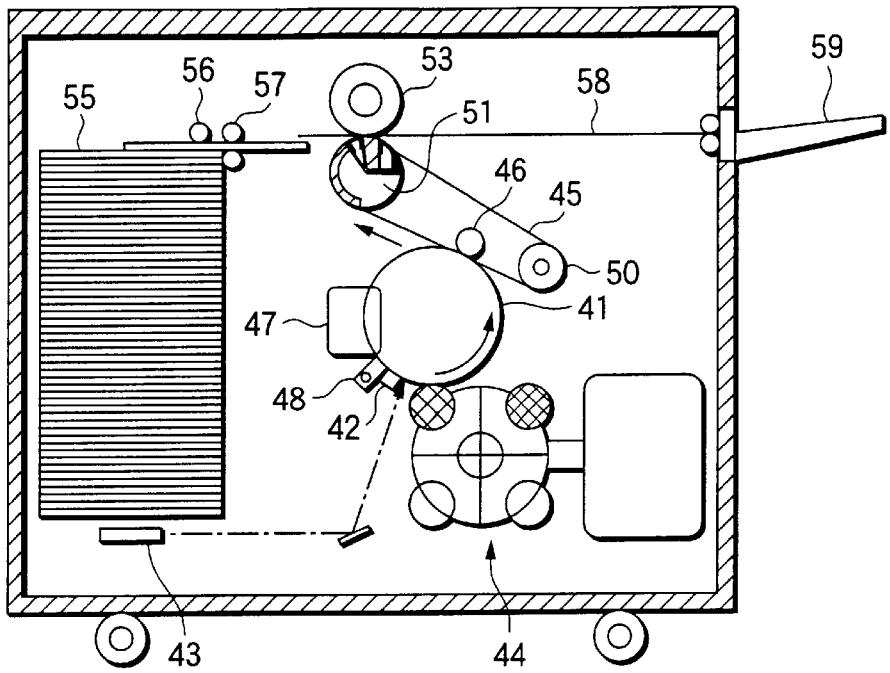
FIGS. 6A and 6B are schematic structural views showing an image forming apparatus of a second embodiment of the present invention.
Figure 6B:
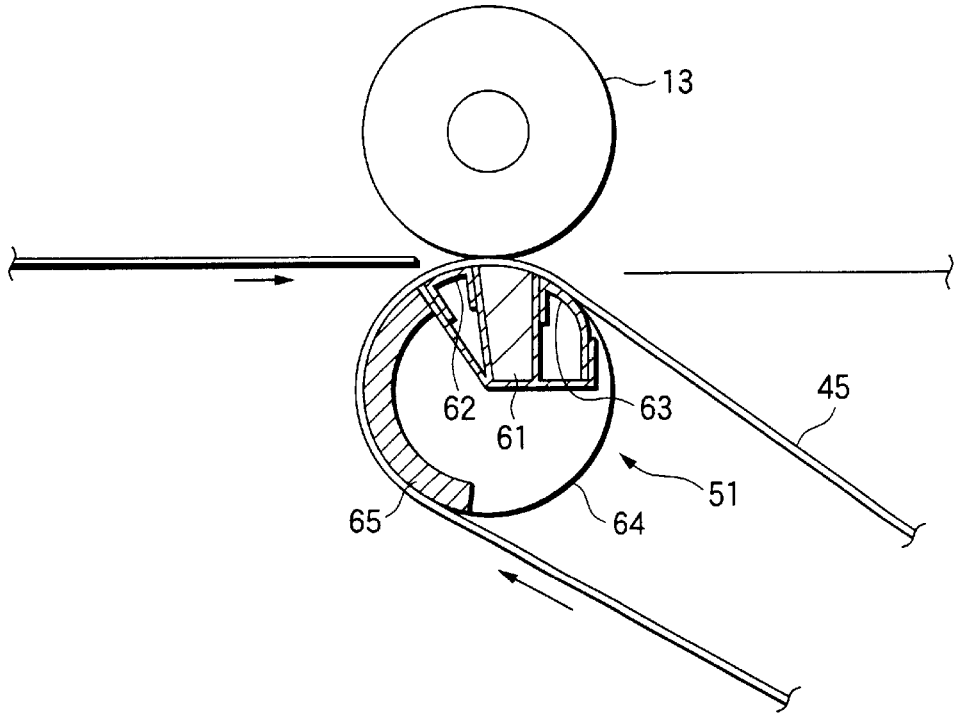

FIG. 6A is a schematic sectional view showing an image forming apparatus of a second embodiment of the present invention, and FIG. 6B is an enlarged sectional view of a secondary transfer portion of this image forming apparatus.

This image forming apparatus adopts a photosensitive drum 41, a charging device 42, an image scanner 43, a rotary developing device 44, a primary transfer roll 46, a cleaning device 47, and a charge-removal exposure device 48, which are the same as those used in the image forming apparatus shown in FIG. 1A. An intermediate transfer member 45 used in this image forming apparatus is an endless belt laid in a tensioned condition between a fixedly supported heating and pressing unit 51 and a driving roll 50, and is circularly driven by the rotation of the driving roll 50. This intermediate transfer member 45 includes a base layer made of heat-resistant resin and a surface release layer on the outside. As the material of the base layer and the surface release layer, the material used for the base layer 5*a* or the surface release layer 5*c* of the intermediate transfer member 5 of the image forming apparatus shown in FIG. 1A can be used. A sliding layer for decreasing friction can also be provided at the inside of the base layer.

As shown in FIG. 6B, the heating and pressing unit 51 includes a fixed pad 61 to be brought into contact with the inner peripheral surface of the intermediate transfer member 45, a corrugation suppressing member 62 provided at its upstream side of the fixed pad 61 in the movement direction of the intermediate transfer member 45, a heating device 65 provided at the upstream side, and a guide member 63 along which the intermediate transfer member 45 is rubbed at the downstream side of the fixed pad 61, and these are fixed and supported in a body by a support member 64.

The fixed pad 61, the corrugation suppressing member 62, and the guide member 63 can be made to have the same materials and the same structures as those used in the image forming apparatus shown in FIG. 1A.

The heating device 65 is a ceramic heater, includes a cylindrical curved surface, and is brought into contact with the inner peripheral surface of the intermediate transfer member 45. The intermediate transfer member 45 slides while it comes in close contact with the cylindrical curved surface and is heated. A pressure roll 53 is pressed to the fixed pad 61 of the heating and pressing unit 51 through the intermediate transfer member 45 therebetween and forms a nip portion.

In addition to the above constitution, also with respect to a sheet feeding unit 55, a sheet feeding roll 56, a registration roll 57, a recording member guide 58, and a sheet exhaust tray 59, the same elements as those of the image forming apparatus shown in FIG. 1A are adopted.

In the image forming apparatus like this, the intermediate transfer member 45 is circularly driven by the rotation of the driving roll 50, and toner images are sequentially overlapped and are transferred from the photosensitive drum 41. Then, it is brought into close contact with the cylindrical curved surface of the heating device 65 in a state where the overlapped toner images of four colors of yellow, cyan, magenta and black are carried, and the toner images are heated to be melted. Further, the intermediate transfer member 45 is guided from the cylindrical curved surface of the heating device 65 to the convex curved surface of the corrugation suppressing member 62, and is sent, without producing a corrugated state, to the nip portion where the pressure roll 53 is pressed against the fixed pad 61 by pressure. The recording member overlapping with the intermediate transfer member 45 is sent to the nip portion, and the melted toner is attached to the recording member by pressure in the nip. At this time, when setting is made so that the distribution of the nip pressure becomes high at a place near the inlet, it becomes possible to more certainly perform the transfer and fixation.

<Third Embodiment>

Figure 7:
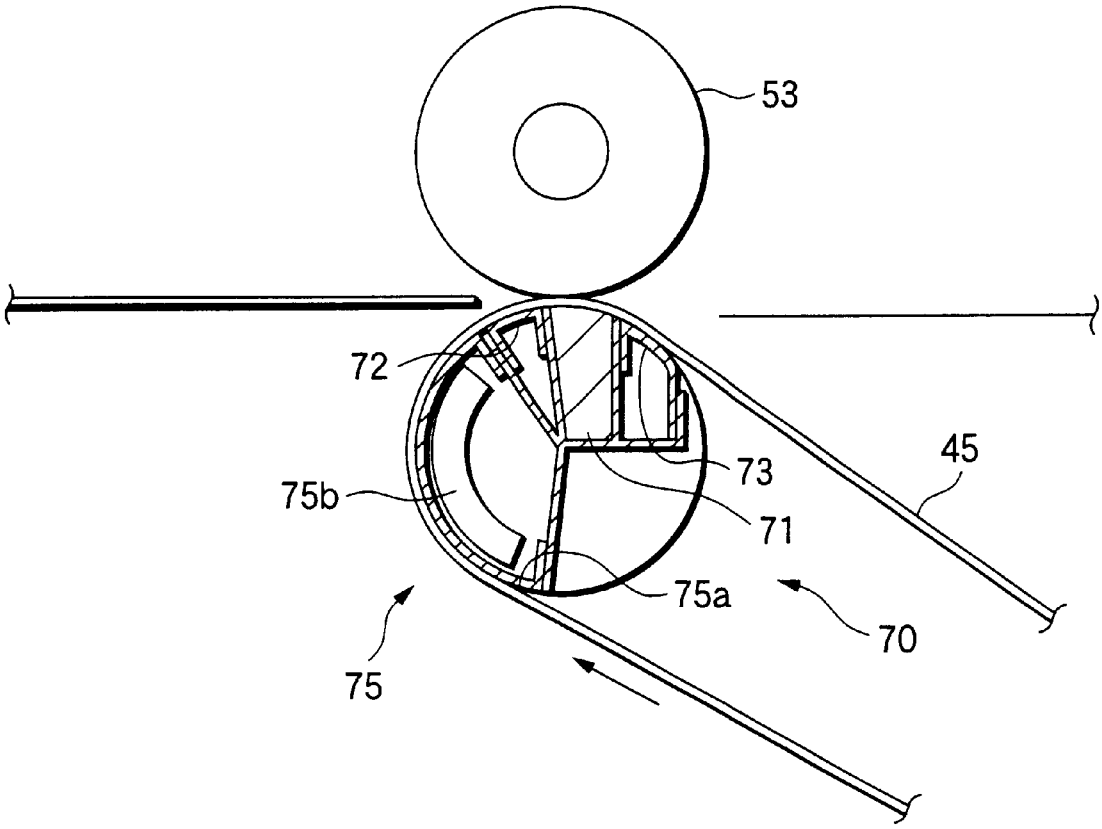
FIG. 7 is a main portion structural view showing an image forming apparatus of a third embodiment of the present invention.

FIG. 7 is a schematic sectional view showing another example of a heating and pressing unit which can be used instead of the heating and pressing unit 51 of the image forming apparatus shown in FIG. 6A.

This heating and pressing unit 70 uses an electromagnetic induction heating device 75 as a heating device. A metal thin plate 75*a* having conductivity is bent to form a cylindrical curved surface, it comes in contact with the inner peripheral surface of the intermediate transfer member 45 to guide the circular movement, and an exciting coil 75*b* is arranged at the inside. A high frequency voltage is applied to this exciting coil 75*b,* so that a fluctuating magnetic field is generated, and eddy current is generated in the metal thin plate 75*a* to generate heat. By this, the circularly moving intermediate transfer member 45 and the toner image carried by this are heated. On the other hand, a fixed pad 71, a corrugation suppressing member 72, and a guide member 73 are the same as those of the heating and pressing unit 51 shown in FIG. 6A, and the toner image melted by the electromagnetic induction heating device 75 is attached to the recording member by pressure at the nip portion.

<Fourth Embodiment>

Figure 8:
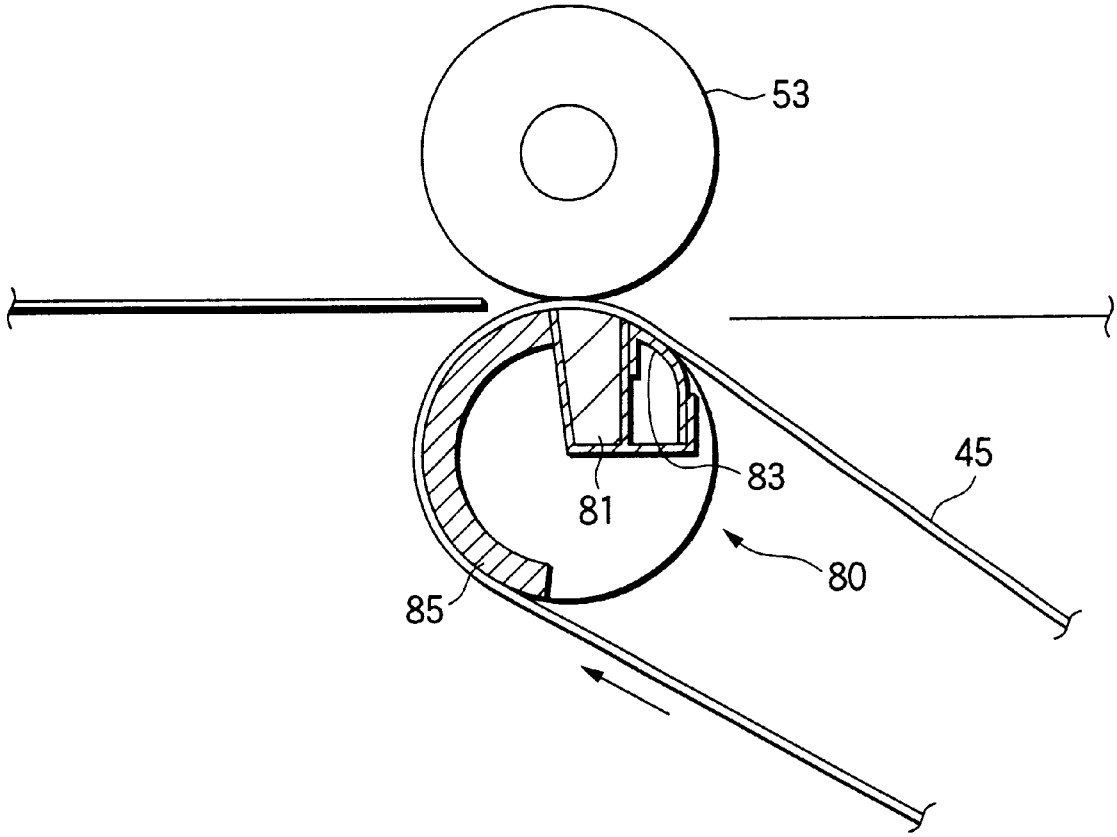
FIG. 8 is a main portion structural view showing an image forming apparatus of a fourth embodiment of the present invention.

FIG. 8 shows a heating and pressing unit used in an image forming apparatus of a fourth embodiment of the present invention, and is schematic sectional view showing one which can be used instead of the heating and pressing unit shown in FIGS. 6A and 6B.

That is, a corrugation suppressing member is not used, but such a structure may be adopted that a convex curved surface is brought into contact with an intermediate transfer member at a portion where heating is performed. That is, it is possible to adopt one in which a surface of a heating device to be brought into contact with the inner peripheral surface of the intermediate transfer member is made a convex curved surface, or one in which a member forming a convex curved surface is kept at high temperature and heats the rubbed intermediate transfer member.

In this heating and pressing unit 80, a corrugation suppressing member is not used, but a cylindrical curved surface of a heating device 85 made of a ceramic heater is substantially continuous with a contact surface of a fixed pad 81 to an intermediate transfer member 45. The fixed pad 81 and a guide member 83 used in this heating and pressing unit are the same as those of the apparatus shown in FIG. 6A.

In the apparatus like this, the intermediate transfer member 45 is brought into close contact with the cylindrical curved surface of the heating device 85, and is moved while being heated, and the cylindrical curved surface of the heating device itself prevents corrugated wrinkles from being produced. Then, toner melted by heating is attached by pressure between the fixed pad 81 and a pressure roll 53.

<Fifth Embodiment of Image Forming Apparatus>

Figure 9:
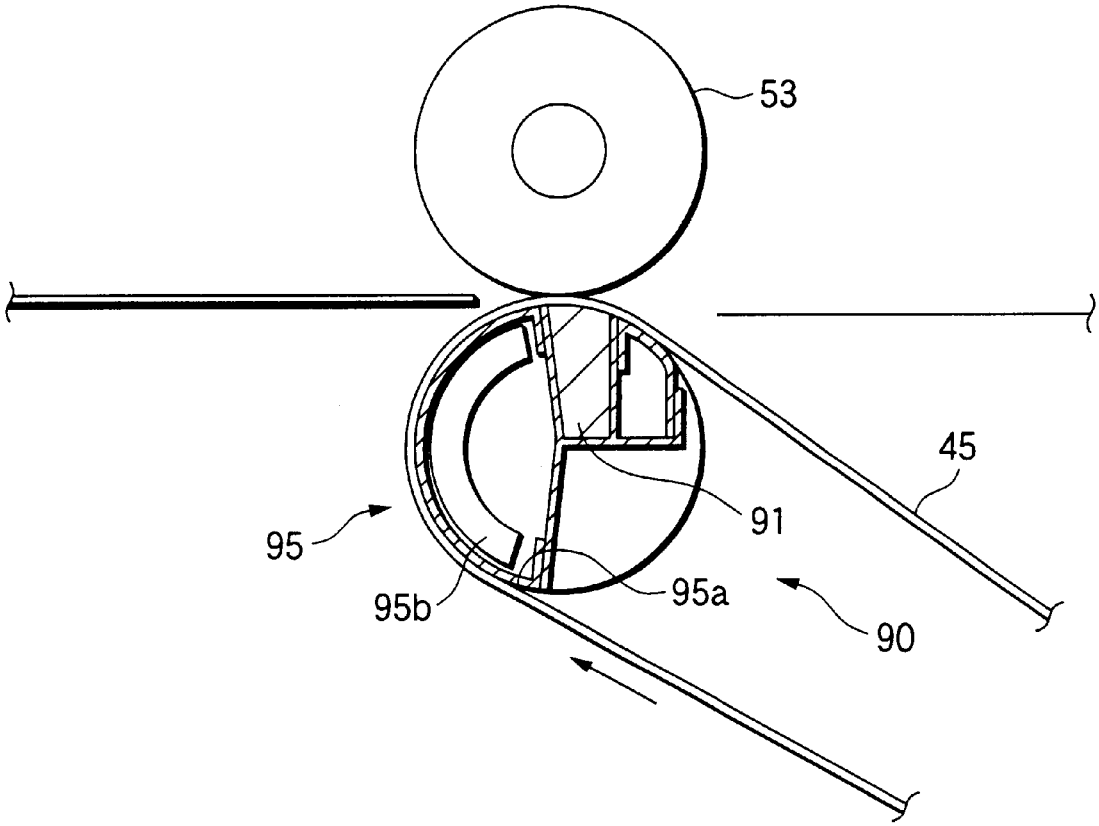
FIG. 9 is a main portion structural view showing an image forming apparatus of a fifth embodiment of the present invention.

FIG. 9 shows a heating and pressing unit used in an image forming apparatus of a fifth embodiment of the present invention, and is a schematic sectional view showing one which can be used instead of the heating and pressing unit shown in FIGS. 6A and 6B.

Alto in this heating and pressing unit 90, a corrugation suppressing member is not used, but a heating device 95 includes a metal thin plate 95*a* having a cylindrical curved surface and an exciting coil 95*b* arranged to face this, and the cylindrical curved surface of the metal thin plate 95*a* is provided to be substantially continuous with a contact surface of a fixed pad 91 to an intermediate transfer member 45.

This metal thin plate 95*a* is heated by eddy current induced by the exciting coil 95*b,* the intermediate transfer member 45 is brought into close contact with the cylindrical curved surface, is moved, and is heated, and the generation of corrugated wrinkles is prevented. Toner images on the intermediate transfer member 45 are melted and are attached to a recording member by pressure at a nip portion.

Next, embodiments of a fixing device of the present invention will be described.

<Sixth Embodiment>

Figure 10A:
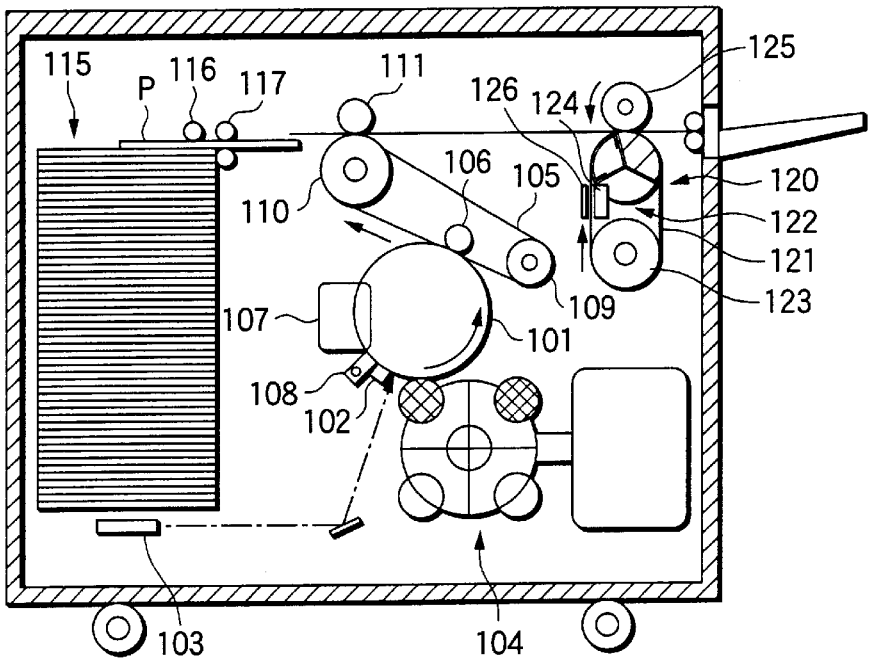
FIGS. 10A and 10B are schematic structural views showing a fixing device of a sixth embodiment of the present invention and an image forming apparatus in which this fixing device is used.
Figure 10B:
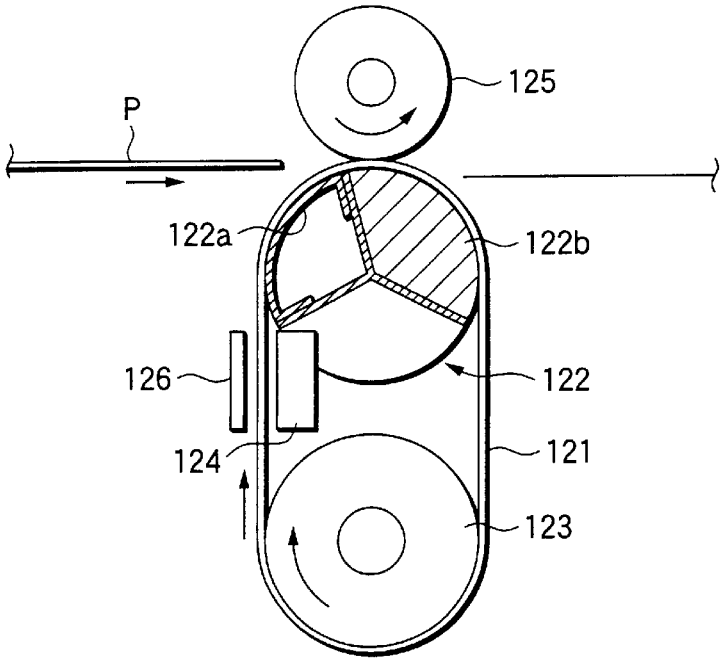

FIGS. 10A and 10B are schematic structure views showing a fixing device of a sixth embodiment of the present invention and an image forming apparatus in which this fixing device is used.

A photosensitive drum 101, a charging device 102, an image scanner 103, a rotary developing device 104, a primary transfer roll 106, a cleaning device 107, and a charge-removal exposure device 108 included in this image forming apparatus are the same as those of the image forming apparatus shown in FIG. 6A. An endless belt shaped intermediate transfer member 105 laid in a tensioned condition to come in contact with the photosensitive drum 101 also includes a base layer and a surface release layer similarly to the image forming apparatus shown in FIG. 6A, and the intermediate transfer member 105 of this image forming apparatus is laid across a driving roll 109 rotated and driven and a tension roll 110 rotatably supported. Then, a transfer roll 111 is arranged to face the tension roll 110 with the intermediate transfer member 105 being interposed therebetween, and a bias voltage is applied between this transfer roll 111 and the tension roll 110.

On the other hand, a recording member P is sent from a sheet feeding unit 115 by a sheet feeding roll 116 and a registration roll 117, and this recording member P is overlapped with the intermediate transfer member 105 carrying toner images and is sent to a place between the transfer roll 111 and the tension roll 110.

The bias voltage operates so that the toner images on the intermediate transfer member 105 are shifted onto the recording member P, and secondary transfer from the intermediate transfer member 105 to the recording member P is performed in an electric field.

A fixing device 120 for heating and pressing the recording member carrying the unfixed toner image to make a fixed image is provided at the downstream side of a secondary transfer portion in the transporting direction of a sheet.

FIG. 10B is a schematic sectional view showing the fixing device 120.

This fixing device 120 includes an endless fixing belt 121, a pressure unit 122 which is brought into contact with an inner peripheral surface of this fixing belt and is fixedly supported, a driving roll 123, together with this pressure roll, for laying the fixing belt in a tensioned condition, an electromagnetic induction heating device 124 arranged to face the fixing belt, and a pressure roll 125 pressed against the pressure unit 122 through the fixing belt 121.

The above fixing belt 121 includes a base layer made of heat-resistant resin, a conductive layer formed at its outside, and a surface release layer formed thereon, and has the same structure as that used as the intermediate transfer member in the image forming apparatus shown in FIG. 1A.

Incidentally, this fixing belt 121 is different from the intermediate transfer member used in the image forming apparatus shown in FIG. 1A, heat may be stored, and it is not necessary to make such a structure that cooling is rapidly performed.

A contact surface of the pressure unit 122 to the fixing belt 121 is a smooth curved surface, a corrugation suppressing member 122*a* is provided at an upstream side portion in the movement direction of the fixing belt 121, and a fixed pad 122*b* is provided at a downstream side. The corrugation suppressing member 122*a* and the fixed pad 122*b* can be made to have the same structures as those used in the pressure unit 11 for laying the intermediate transfer member in a tensioned condition in the image forming apparatus shown in FIG. 1A. The fixed pad 122*b* may be covered with a sheet-like member for reducing friction against the fixing belt 121.

The driving roll 123 is rotated to circularly drive the fixing belt 121.

The electromagnetic induction heating device 124 induces eddy current in the conductive layer of the fixing belt 121 to generate heat, and has the same structure as that used for heating the intermediate transfer member 5 in the image forming apparatus shown in FIG. 1A. Besides, a magnetic flux collecting member 126 identical to that used in the image forming apparatus shown in FIG. 1A is provided.

The pressure roll 125 is pressed to the fixed pad 122*b* and deforms the fixed pad 122*b* to form a nip, where a recording member is interposed between the pressure roll and the fixing belt 121 and is pressed.

The nip is formed at the most upstream side of the fixed pad 122*b,* similarly to the transfer fixation portion of the image forming apparatus shown in FIG. 1A.

Incidentally, the hardness of the fixed pad 122*b,* and the radius and pressing force of the pressure roll 125 are determined so that the length of the nip in the circumferential direction becomes a predetermined length. A member (not shown) made of a material which is hard to deform, such as metal, is embedded under the surface of the fixed pad 122*b* near the inlet of the nip, and the distribution of the nip pressure is set so that it becomes maximum at a place near the inlet of the nip as indicated by a solid line in FIG. 11B.

In the fixing device 120 like this, the fixing belt 121 is circularly driven by the rotation of the driving roll 123, and the fixing belt 121 is heated by the electromagnetic induction heating device 124. The heated fixing belt 121 is moved while it is in close contact with the convex curved surface of the corrugation suppressing member 122*a*. At this time, although corrugated wrinkles are easily generated on the fixing belt 121 by local heating, it is restricted by the convex curved surface and reaches the nip portion without generating the wrinkles. Besides, a drop in temperature can also be suppressed to a slight level.

Figure 11A:
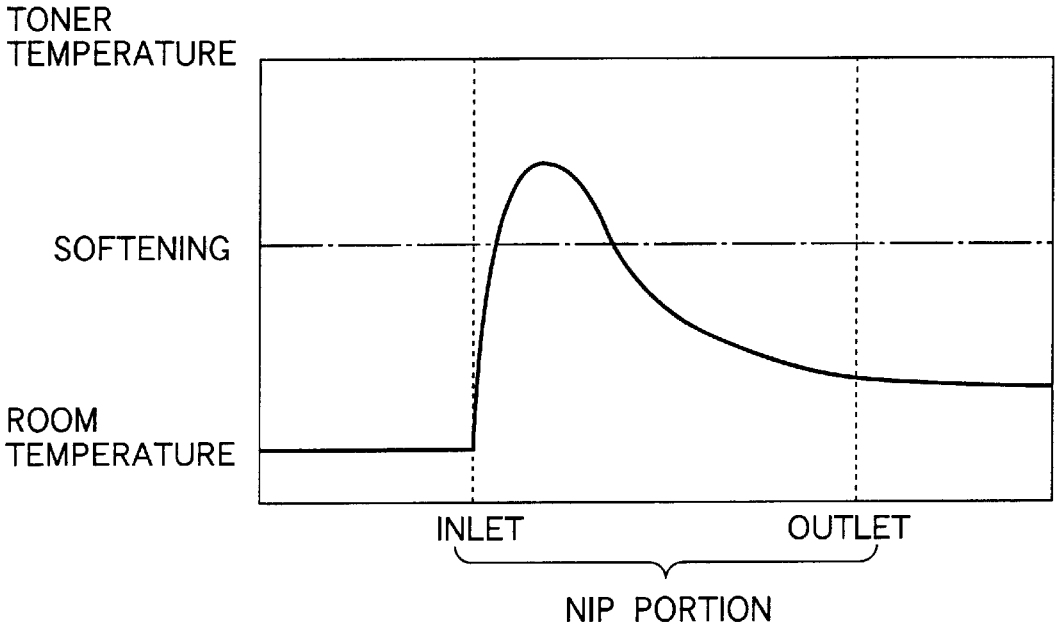
FIGS. 11A and 11B are views showing distributions of toner temperature and nip pressure at a place near a nip of the fixing device shown in FIGS. 10A and 10B.
Figure 11B:
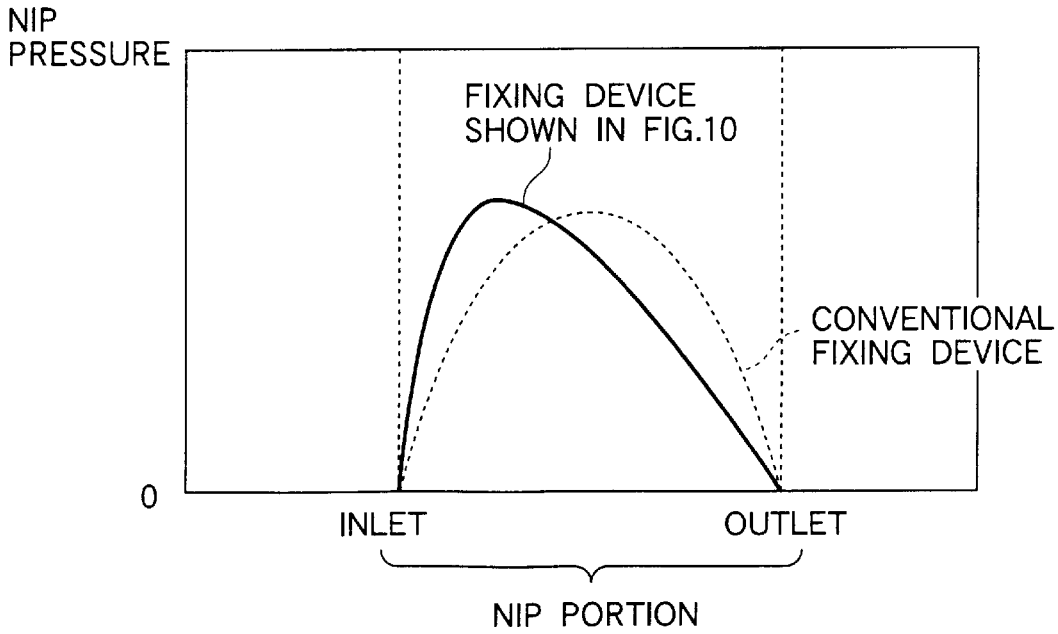

The recording member P which carries the unfixed toner image is sent to the nip portion, and the heated fixing belt 121 is brought into close contact with the unfixed toner image. By this, heat stored in the fixing belt 121 is supplied to the unfixed toner image, the temperature of the toner is rapidly raised as shown in FIG. 11A, and it comes to have a melted state. Thereafter, the heat is absorbed by the recording member, the pressure roll 125 and the like, and the temperature of the toner is lowered. However, as shown in FIG. 11B, since setting is made so that the nip pressure becomes maximum at the place near the inlet of the nip where the temperature of the toner becomes highest, the toner image is permeated in the recording member and excellent fixation is performed.

The temperature of the toner is lowered thereafter, and the toner is in a state where it sufficiently coheres at the outlet of the nip, so that it is peeled off from the fixing belt 121 without causing an offset.

<Seventh Embodiment>

Figure 12A:
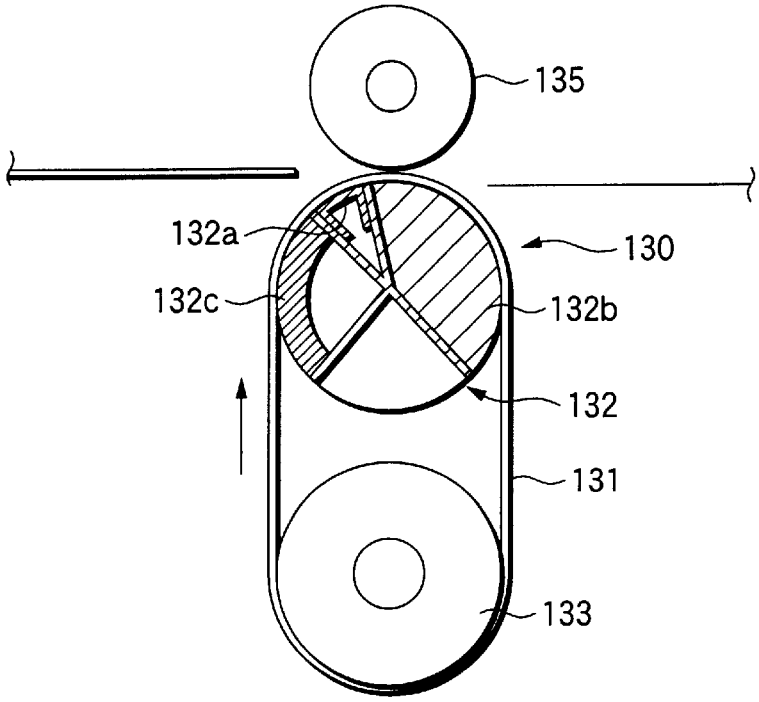
FIGS. 12A and 12B are schematic structural views showing a fixing device of a seventh embodiment of the present invention.
Figure 12B:
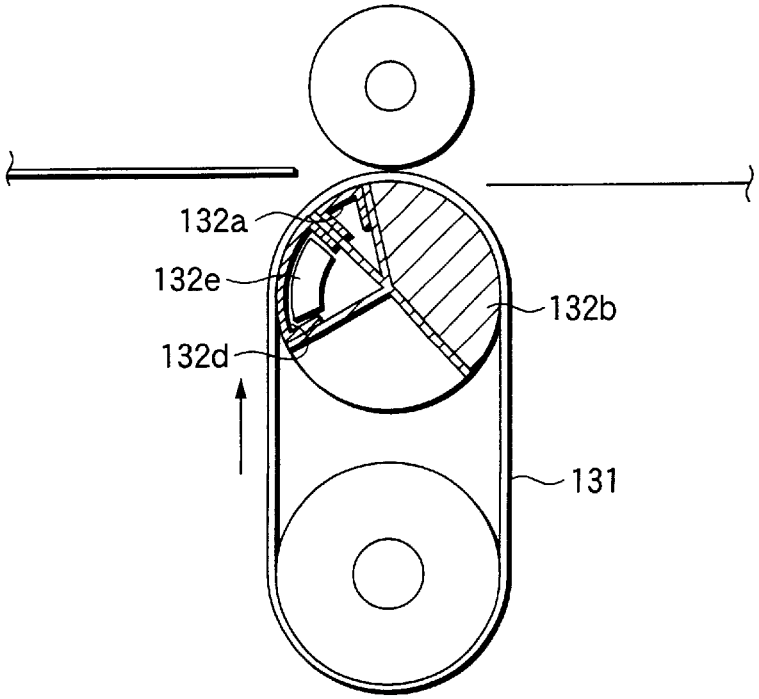

FIGS. 12A and 12B are schematic sectional views of a fixing device of a seventh embodiment of the present invention.

This fixing device 130 can be used instead of the fixing device 120 in the image forming apparatus shown in FIG. 10A.

In this fixing device, a heating device 132*c,* together with a corrugation suppressing member 132*a* and a fixed pad 132*b,* is integrally incorporated as a heating and pressing unit 132. This heating device 132*c* includes a ceramic heater, a surface to be brought into contact with a fixing belt 131 becomes a cylindrical curved surface, and it forms a smooth convex curved surface, together with the corrugation suppressing member 132*a* and the fixed pad 132*b*.

The corrugation suppressing member 132*a* and the fixed pad 132*b* provided at the downstream side of the heating device 132*c* can be formed of the same material as the fixing device 120 shown in FIG. 10B, and the pressure roll 135 is pressed to the fixed pad 132*b* so that a nip is formed.

In the fixing device 130 like this, the fixing belt 131 moving along the curved surface of the heating and pressing unit 132 is heated, and reaches the nip portion without producing wrinkles. Then, the toner on the recording member is melted by the heat stored in the fixing belt 131, and excellent fixation is performed.

Besides, as shown in FIG. 12B, the heating device may be such that a thin plate 132*d* of conductive metal forms a curved surface which is brought into contact with a fixing belt 131, and an exciting coil 132*e* is arranged at the inside to perform electromagnetic induction heating.

<Eighth Embodiment>

Figure 13:
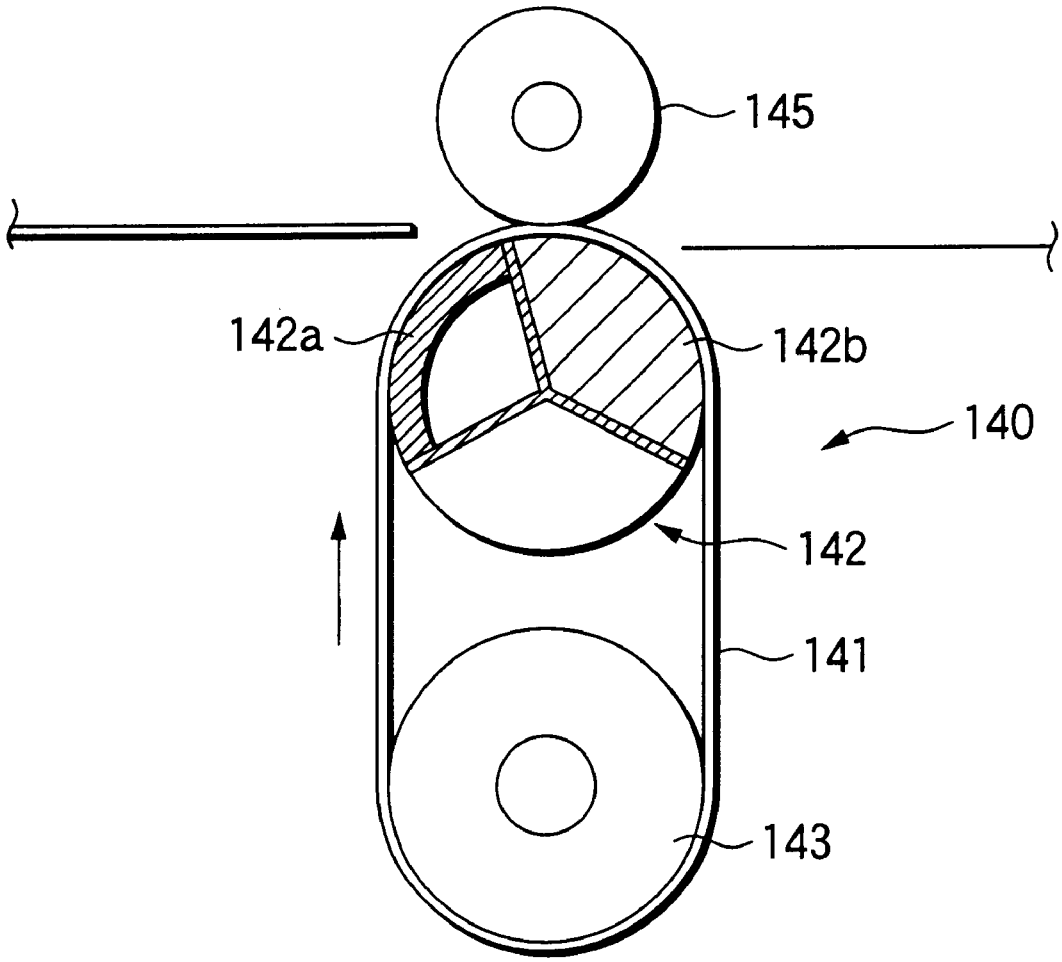
FIG. 13 is a schematic structural view showing a fixing device of an eighth embodiment of the present invention.

FIG. 13 is a schematic sectional view showing a fixing device of an eighth embodiment of the present invention.

In this fixing device 140, a corrugation suppressing member is not used in a heating and pressing unit 142, but a convex curved surface of a ceramic heater 142*a* as a heating device is provided to be continuous with a contact surface of a fixed pad 142*b* to a fixing belt 141.

In the fixing device 140 like this, the fixing belt 141 is heated by the heating device 142*a,* and reaches a nip portion without producing corrugated wrinkles by the convex curved surface of the heating device 142*a*.

<Ninth Embodiment>

Figure 14:
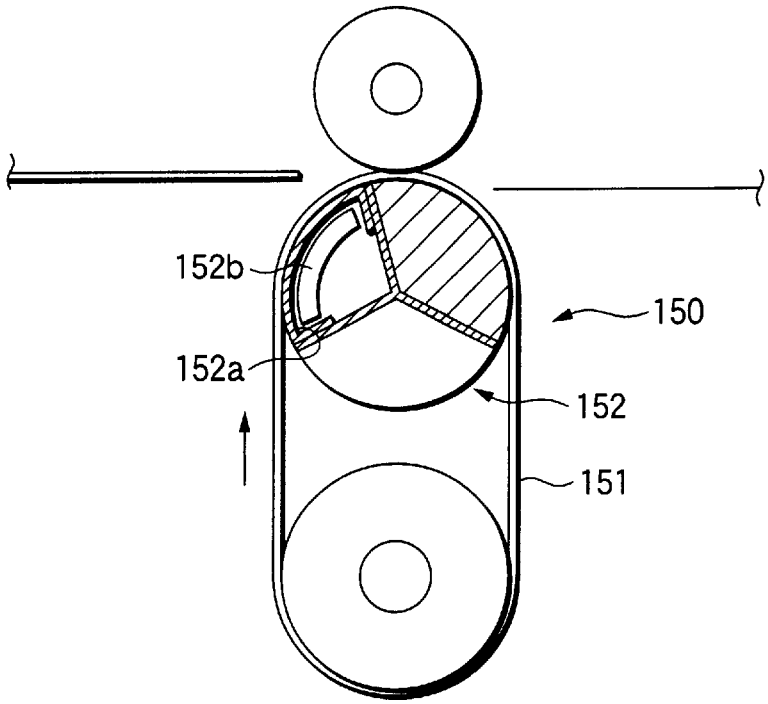
FIG. 14 is a schematic structural view showing a fixing device of a ninth embodiment of the present invention.

FIG. 14 is a schematic sectional view showing a fixing device of a ninth embodiment of the present invention.

This fixing device 150 adopts an electromagnetic induction heating device instead of the ceramic heater in the fixing device shown in FIG. 13. At a portion which is brought into contact with a fixing belt 151, a convex curved surface is formed by a thin metal plate 152*a* having conductivity, and an exciting coil 152*b* is arranged at the inside of this metal plate 152*a*. Eddy current is induced in the metal plate 152*a* by a fluctuating magnetic field generated by this exciting coil 152*b* and heat is generated.

<Tenth Embodiment>

Figure 15:
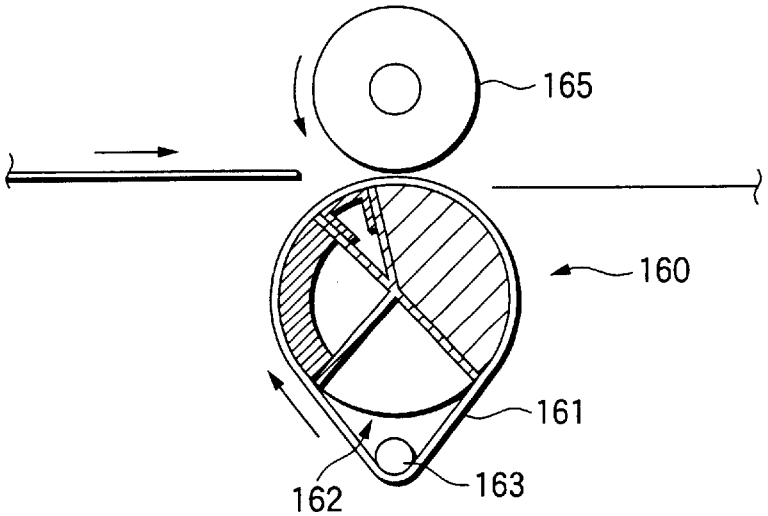
FIG. 15 is a schematic structural view showing a fixing device of a tenth embodiment of the present invention.

FIG. 15 is a schematic sectional view of a fixing device of a tenth embodiment of the present invention.

Although this fixing device 160 includes a heating and pressing unit 162 identical to that of the fixing device shown in FIG. 12A, a thin roll having a small diameter is used as a driving roll 163. Then, a fixing belt 161 is wound on only the driving roll 163 and the heating and pressing unit 162 so that it is short.

Although the driving roll 163 is rotated and driven, it subsidiarily drives the fixing belt 161 circularly, and the circular driving of this fixing belt is performed by rotating the pressure roll 165 pressed against the outer peripheral surface of the fixing belt 161 by pressure.

In the fixing device like this, the circumferential length of the fixing belt 161 is short, and the whole heat capacity is small. Besides, the driving roll 163 also has the small diameter, and the thickness of the member at the peripheral surface portion is small, so that the heat capacity is small. Accordingly, although heat used for heating the fixing belt 161 is stored in the fixing belt 161 and the driving roll 163, the amount of heat may be small, and the amount of dissipated heat also becomes small. Accordingly, efficient heating becomes possible.

Incidentally, such a structure may be adopted that instead of the driving roll 163, a rotatably supported roll is used, and all driving force is given to the fixing belt from the pressure roll 165. Besides, the fixing belt 161 may be one which is supported in a state where tensile stress hardly operates. At this time, a fixedly supported guide member may be used instead of the driving roll 163 or the rotatable roll.

On the other hand, also in the fixing devices shown in FIGS. 12B, 13 and 14, the fixing belt, the driving roll, and the pressure roll can be made to have the structure shown in FIG. 15 by using the same heating and pressing unit. Besides, the fixing device shown in FIG. 10B is also made such that the diameter of the driving roll 123 is made small in the range where the electromagnetic induction heating device 124 can be arranged, and the peripheral length of the fixing belt 121 is made short.

As described above, in the image forming apparatus of the present invention, a toner image is heated on an endless belt shaped intermediate transfer member, and this is attached to a recording medium by pressure in a non-heating state, so that heat energy can be efficiently used, and transfer and fixation can be performed at the same time. Although corrugated wrinkles are easily generated in the intermediate transfer member of a thin belt between a position where the intermediate transfer member is heated to a nip where the toner image is attached to the recording medium by pressure, the generation of the wrinkles can be effectively prevented by bringing a corrugation suppressing member or a convex curved surface of a heating device into close contact with the intermediate transfer member from the inside thereof. Further, since setting is made so that the nip pressure becomes maximum at a place near an inlet in the nip, toner is intensely pressed to the recording medium before the temperature of the melted toner is lowered, and excellent transfer and fixation becomes possible at the same time.

On the other hand, in the fixing device of the present invention, an endless fixing belt is heated, and this is pressed to a toner image on a recording medium of room temperature, so that fixation with excellent use efficiency of heat energy becomes possible. Besides, it is possible to effectively prevent corrugated wrinkles from being produced on the fixing belt, and excellent fixation can be performed.

The entire disclosure of Japanese Patent Application No. 2000-296169 filed on Sep. 28, 2000 including specification, claims, drawings and abstract is incorporated herein by reference in its entirety.

What is claimed is:

1. An image forming apparatus, comprising:

an image carrier which has an endless circumferential surface and on which a toner image is formed of toner selectively shifted onto the circumferential surface;

an intermediate transfer member which is an endless belt shaped member laid across at least two members in a tensioned condition and is circularly driven, the toner image on the image carrier being primary transferred onto an outer peripheral surface of the intermediate transfer member; and a transfer fixation device which heats the toner image on the intermediate transfer member, attaches the melted toner to a recording medium by pressure, and performs secondary transfer and fixation at the same time, wherein the transfer fixation device comprises:

a fixed pad fixedly supported to be brought into contact with an inner peripheral surface of the intermediate transfer member, the intermediate transfer member being rubbed against a contact surface of the fixed pad;

a pressure roll pressed against the fixed pad by pressure through the intermediate transfer member being interposed therebetween;

a heating device for heating and melting the toner on the intermediate transfer member at an upstream side of a contact position of the fixed pad in a movement direction of the intermediate transfer member; and a corrugation suppressing member having a curved surface provided along the inner peripheral surface of the intermediate transfer member in its circumferential direction between a position where the heating device is provided and a position where the fixed pad is provided wherein the curved surface is in contact with the intermediate transfer member.

2. The image forming apparatus according to claim 1, wherein in a nip, defined by a region where the fixed pad and pressure roll are pressed against each other through the intermediate transfer member and a recording medium interposed therebetween, a pressure distribution in a circumferential direction in the nip becomes maximum proximate an inlet of the nip.

3. The image forming apparatus according to claim 1, wherein at least a portion of the corrugation suppressing member in close contact with the intermediate transfer member is made of a heat-resistant film or a thin plate-like member.

4. The image forming apparatus according to claim 1, wherein the corrugation suppressing member is supported to be continuous to the upstream side of the fixed pad.

5. The image forming apparatus according to claim 1, wherein the intermediate transfer member includes a conductive layer, the heating device includes an exciting coil which is arranged to face the intermediate transfer member and to which high frequency voltage is applied, and an eddy current is generated in the conductive layer by electromagnetic induction to generate heat in the conductive layer.

6. The image forming apparatus according to claim 1, wherein the heating device includes a metal thin plate fixedly supported to come in contact with the inner peripheral surface of the intermediate transfer member and an exciting coil which is arranged to face the metal thin plate and to which a high frequency voltage is applied, and an eddy current is generated in the metal thin plate by electromagnetic induction to generate heat in the metal thin plate.

7. The image forming apparatus according to claim 1, wherein a surface of the fixed pad rubbing against the intermediate transfer member is covered with a sheet for reducing friction.

8. The image forming apparatus according to claim 1, wherein the heating device is brought into contact with the inner peripheral surface of the intermediate transfer member, and its contact surface is continuous with or close to the surface of the fixed pad being in contact with the intermediate transfer member to form a continuous convex curved surface.

9. The image forming apparatus according to claim 1, wherein the corrugation suppressing member is brought into contact with the inner peripheral surface of the intermediate transfer member, and its contact surface is continuous with or close to the surface of the fixed pad being in contact with the intermediate transfer member to form a continuous convex curved surface.

10. The image forming apparatus according to claim 1, wherein the fixed pad, the corrugation suppressing member, and the heating device are one or part of the members across which the endless belt shaped intermediate transfer member is laid in a tensioned condition.

11. An image forming apparatus, comprising:

an image carrier which has an endless circumferential surface and on which a toner image is formed of toner selectively shifted onto the circumferential surface;

an intermediate transfer member which is an endless belt shaped member laid across at least two members in a tensioned condition and is circularly driven, the toner image on the image carrier being primary transferred onto an outer peripheral surface of the intermediate transfer member; and a transfer fixation device which heats the toner image on the intermediate transfer member, attaches the melted toner to a recording medium by pressure, and performs secondary transfer and fixation at the same time, wherein the transfer fixation device comprises:

a fixed pad fixedly supported to be brought into contact with an inner peripheral surface of the intermediate transfer member, the intermediate transfer member being rubbed against a contact surface of the fixed pad;

a pressure roll pressed against the fixed pad by pressure through the intermediate transfer member being interposed therebetween; and a heating device for heating and melting the toner on the intermediate transfer member at an upstream side of a contact position of the fixed pad in a movement direction of the intermediate transfer member, and wherein in a nip, defined by a region where the fixed pad and the pressure roll are pressed against each other through the intermediate transfer member and a recording medium interposed therebetween, a pressure distribution in a circumferential direction in the nip becomes maximum proximate an inlet of the nip.

12. The image forming apparatus according to claim 11, wherein the intermediate transfer member includes a conductive layer, the heating device includes an exciting coil which is arranged to face the intermediate transfer member and to which high frequency voltage is applied, and an eddy current is generated in the conductive layer by electromagnetic induction to generate heat in the conductive layer.

13. The image forming apparatus according to claim 11, wherein the heating device is brought into contact with the inner peripheral surface of the intermediate transfer member, and its contact surface is continuous with or close to the surface of the fixed pad being in contact with the intermediate transfer member to form a continuous convex curved surface.

14. A fixing device for heating and pressing a sheet-like recording medium onto which a toner image formed by a selective shift of toner has been transferred, to fix the toner image to the recording medium, comprising:

an endless fixing belt which is laid across at least two members in a tensioned condition and is circularly driven;

a fixed pad fixedly supported to come in contact with an inner peripheral surface of the fixing belt;

a pressure roll for pressurizing the fixing belt and the recording medium placed thereon interposed between the pressure roll and the fixed pad;

a heating device for heating the toner image on the fixing belt at an upstream side of a position where the fixed pad is brought into contact with the fixing belt; and a corrugation suppressing member provided along the inner peripheral surface of the fixing belt in its circumferential direction between a position where the toner image is heated and a position where the fixed pad is provided.

15. The fixing device according to claim 14, wherein in a nip, defined by a region where the fixed pad and pressure roll are pressed against each other through the intermediate transfer member and a recording medium interposed therebetween, a pressure distribution in a circumferential direction in the nip becomes maximum proximate an inlet of the nip.

16. The fixing device according to claim 14, wherein at least a portion of the corrugation suppressing member in close contact with the fixing belt is made of a heat-resistant film or a thin plate-like member.

17. The fixing device according to claim 14, wherein a surface of the corrugation suppressing member in contact with the fixing belt is continuous with or close to a surface of the fixed pad in contact with the fixing belt to form a continuous convex curved surface.

18. The fixing device according to claim 14, wherein the fixing belt includes a conductive layer, the heating device includes an exciting coil which is arranged to face the fixing belt and to which high frequency voltage is applied, and an eddy current is generated in the conductive layer by electromagnetic induction to generate heat in the conductive layer.

19. The fixing device according to claim 14, wherein the heating device includes a metal thin plate fixedly supported to come in contact with the inner peripheral surface of the fixing belt and an exciting coil which is arranged to face the metal thin plate and to which a high frequency voltage is applied, and an eddy current is generated in the metal thin plate by electromagnetic induction to generate heat in the metal thin plate.

20. The fixing device according to claim 14, wherein a surface of the fixed pad rubbing against the fixing belt is covered with a sheet for reducing friction.

21. The fixing device according to claim 14, wherein the heating device is brought into contact with the inner peripheral surface of the fixing belt, and its contact surface is continuous with or close to a surface of the fixed pad in contact with the fixing belt to form a continuous convex curved surface.

22. The fixing device according to claim 14, wherein the fixed pad, the corrugation suppressing member, and the heating device are one or part of the members across which the endless fixing belt is laid in a tensioned condition.

23. A fixing device for heating and pressing a sheet-like recording medium onto which a toner image formed by a selective shift of toner has been transferred, to fix the toner image to the recording medium, comprising:

an endless fixing belt which is laid across at least two members in a tensioned condition and is circularly driven;

a fixed pad fixedly supported to come in contact with an inner peripheral surface of the fixing belt;

a pressure roll for pressurizing the fixing belt and the recording medium placed thereon interposed between the pressure roll and the fixed pad; and a heating device for heating the toner image on the fixing belt at an upstream side of a position where the fixed pad is brought into contact with the fixing belt, wherein in a nip, defined by a region where the fixed pad and the pressure roll are pressed against each other through the fixing belt and the recording medium interposed therebetween, a pressure distribution in a circumferential direction in the nip becomes maximum proximate an inlet of the nip.

24. The fixing device according to claim 23, wherein the heating device is brought into contact with the inner peripheral surface of the fixing belt, and its contact surface is continuous with or close to a surface of the fixed pad in contact with the fixing belt to form a continuous convex curved surface.

* * * * *